US012692110B2

(12) United States Patent
Ambe

(10) Patent No.: US 12,692,110 B2
(45) Date of Patent: Jul. 28, 2026

(54) SHEET FEEDING DEVICE INCLUDING FRAME, FEEDING ROLLER, HOLDER HOLDING FEEDING ROLLER, AND STOPPER CONFIGURED TO RESTRICT MOVEMENT OF HOLDER AND HAVING SLOPED SURFACE

(71) Applicant: BROTHER KOGYO KABUSHIKI KAISHA, Nagoya (JP)

(72) Inventor: Yurimi Ambe, Nisshin (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 18/974,467

(22) Filed: Dec. 9, 2024

(65) Prior Publication Data

US 2025/0223122 A1 Jul. 10, 2025

(30) Foreign Application Priority Data

Jan. 9, 2024 (JP) ..... 2024-001482

(51) Int. Cl.
*B65H 3/06* (2006.01)
*B65H 1/04* (2006.01)
*B65H 5/06* (2006.01)

(52) U.S. Cl.
CPC ..... *B65H 5/06* (2013.01); *B65H 1/04* (2013.01); *B65H 2402/50* (2013.01)

(58) Field of Classification Search
CPC ..... B65H 5/06; B65H 1/04; B65H 2402/50; B65H 3/06; B65H 3/0669; B65H 3/0607
See application file for complete search history.

(56) References Cited

U.S. PATENT DOCUMENTS 7,025,345 B2 * 4/2006 Frazier ..... B65H 3/5261 271/109
9,272,858 B2 * 3/2016 Hirose ..... B41J 13/076
10,584,006 B2 * 3/2020 Suzuki ..... B65H 5/062
2013/0256971 A1 * 10/2013 Ueyama ..... G03G 21/1633 271/10.11
2016/0177989 A1 * 6/2016 Alagos ..... B65H 3/0684 403/326
2021/0087005 A1 3/2021 Uchida
2023/0023244 A1 * 1/2023 Yoshida ..... B65H 3/0684

FOREIGN PATENT DOCUMENTS

JP 2013-209191 A 10/2013
JP 2021-050072 A 4/2021

* cited by examiner

*Primary Examiner* — Thomas A Morrison
(74) *Attorney, Agent, or Firm* — Merchant & Gould P.C.

(57) ABSTRACT

A sheet feeding device includes: a frame; a feeding roller rotatable about an axis extending in an axial direction; a holder holding the feeding roller and attachable to the frame; and a stopper. The holder attached to the frame is movable in the axial direction relative to the frame between: a non-detachable position in which the holder is non-detachable from the frame; and a detachable position in which the holder is detachable from the frame. The stopper is movable between: a restricting position in which the stopper restricts the holder from moving in a specific direction; an allowing position in which the stopper allows the holder to move in the specific direction. The specific direction is a direction from the non-detachable position toward the detachable position. The stopper has a sloped surface configured to contact a portion of the holder on a downstream side in the specific direction.

19 Claims, 16 Drawing Sheets

SHEET FEEDING DEVICE INCLUDING FRAME, FEEDING ROLLER, HOLDER HOLDING FEEDING ROLLER, AND STOPPER CONFIGURED TO RESTRICT MOVEMENT OF HOLDER AND HAVING SLOPED SURFACE

REFERENCE TO RELATED APPLICATIONS

This application claims priority from Japanese Patent Application No. 2024-001482 filed on Jan. 9, 2024. The entire content of the priority application is incorporated herein by reference.

BACKGROUND ART

Conventionally, a sheet feeding device including a feeding roller is provided in an image forming apparatus such as a laser printer for feeding a sheet from a sheet tray. The feeding roller in the sheet feeding device is attached to a frame of a main housing through a holder so as to be detachable from the frame so that the feeding roller can be replaced when deteriorated.

For example, a conventional sheet feeding device includes a feeding roller, a holder holding the feeding roller and supported by a frame so as to be movable in an axial direction of the feeding roller, and a stopper supported by the frame so as to be pivotally movable between: a restricting position in which the stopper restricts movement of the holder; and an allowing position in which the stopper allows the movement of the holder.

In this conventional sheet feeding device, the holder is attachable to and detachable from the frame by moving the holder in the axial direction of the feeding roller while the stopper is pivotally moved to be positioned at the allowing position.

SUMMARY

However, in a case where a user releases the user's hand from the stopper positioned at the allowing position, the stopper is pivotally moved back to the restricting position so that a step portion in the stopper is hooked to the holder, thereby hindering the holder from moving in the axial direction of the feeding roller. Accordingly, in order to attach and detach the holder to and from the frame, the user must hold the stopper at the allowing position with one hand and move the holder with the other hand. This process causes the attachment operation and the detachment operation of the holder relative to the frame to be complicated.

In view of the foregoing, it is an object of the present disclosure to provide a sheet feeding device in which a holder can be moved with one hand, even when a stopper is not held with the other hand, without any hindrance to movement of the holder in an axial direction of a feeding roller.

In order to attain the above and other objects, the present disclosure provides a sheet feeding device including: a frame; a feeding roller; a holder; and a stopper. The feeding roller is rotatable about an axis extending in an axial direction. The feeding roller is configured to feed a sheet. The holder holding the feeding roller. The holder is attachable to the frame. The holder attached to the frame is movable in the axial direction relative to the frame between: a non-detachable position in which the holder is non-detachable from the frame; and a detachable position in which the holder is detachable from the frame. The stopper is movable between: a restricting position in which the stopper restricts the holder from moving in a specific direction; an allowing position in which the stopper allows the holder to move in the specific direction. The specific direction is a direction from the non-detachable position toward the detachable position. The stopper has a sloped surface sloped relative to the axial direction so as to extend downward toward a downstream side in the specific direction. The sloped surface is configured to contact a portion of the holder on the downstream side in the specific direction.

In the above structure, when the holder is moved toward the detachable position from the non-detachable position, the sloped surface of the stopper contacts the portion of the holder on the downstream side in the specific direction. Accordingly, the holder can be moved smoothly to the detachable position without being hooked on the stopper. Consequently, both the operation for moving the stopper toward the allowing position and the operation for moving the holder to the detachable position from the non-detachable position can be performed with one hand. That is, the holder can be moved with one hand even when the stopper is not held with the other hand without any hindrance to the movement of the holder in the axial direction.

DESCRIPTION

Hereinafter, one embodiment of the present disclosure will be described while referring to the accompanying drawings.

[Image Forming Apparatus]

Figure 1:
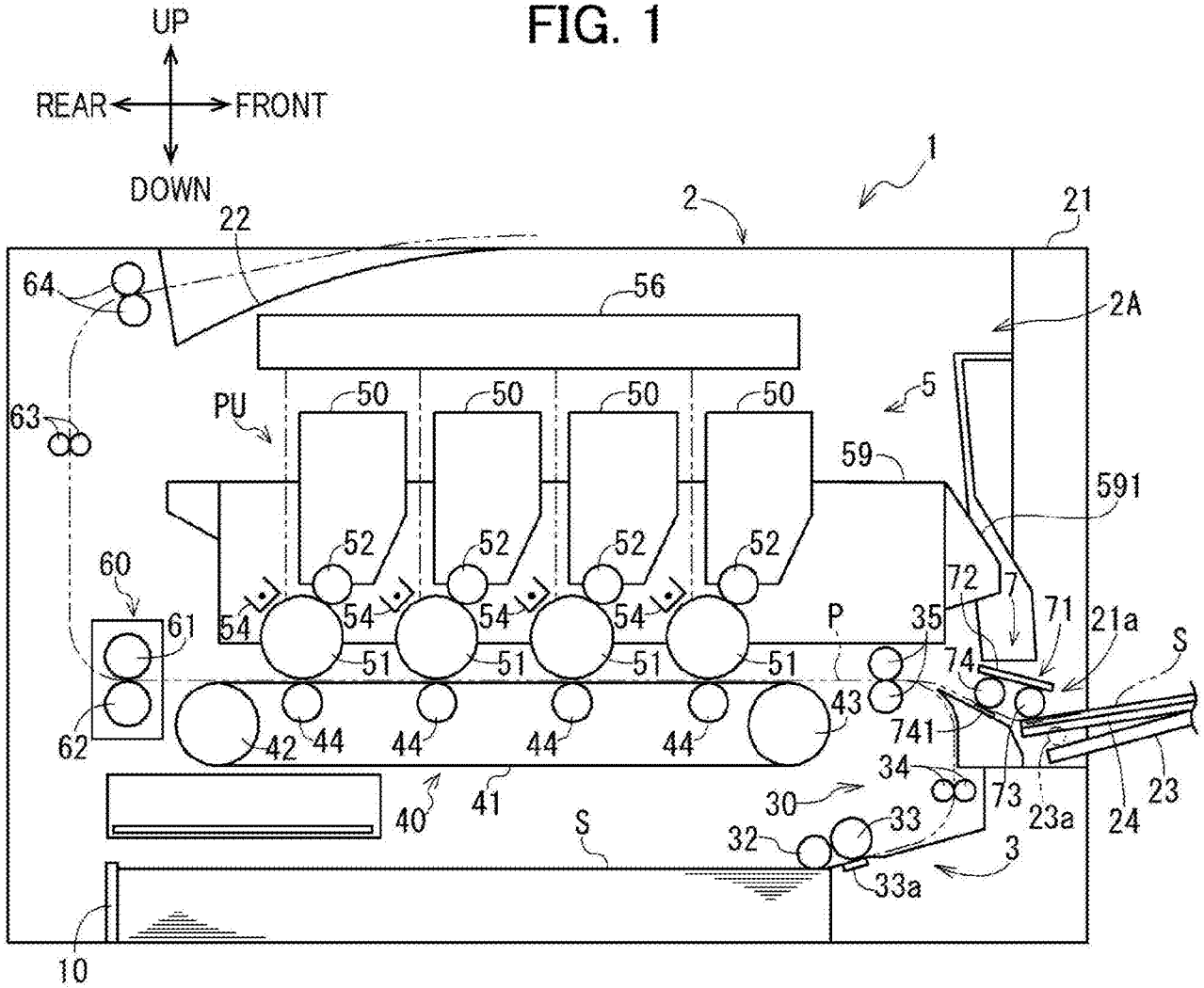
FIG. 1 is a central cross-sectional view illustrating an image forming apparatus.
Figure 2:
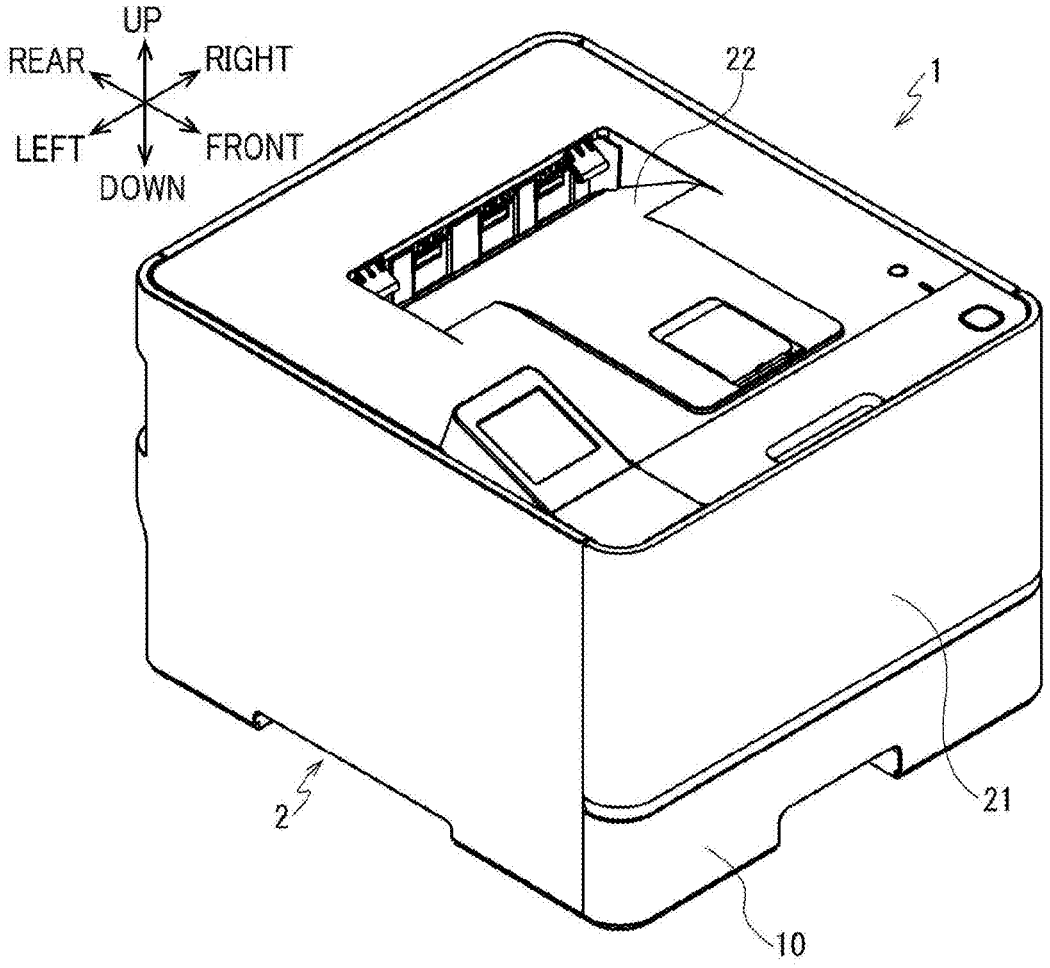
FIG. 2 is a perspective view illustrating the image forming apparatus in which a front cover is at a closed position.
Figure 3:
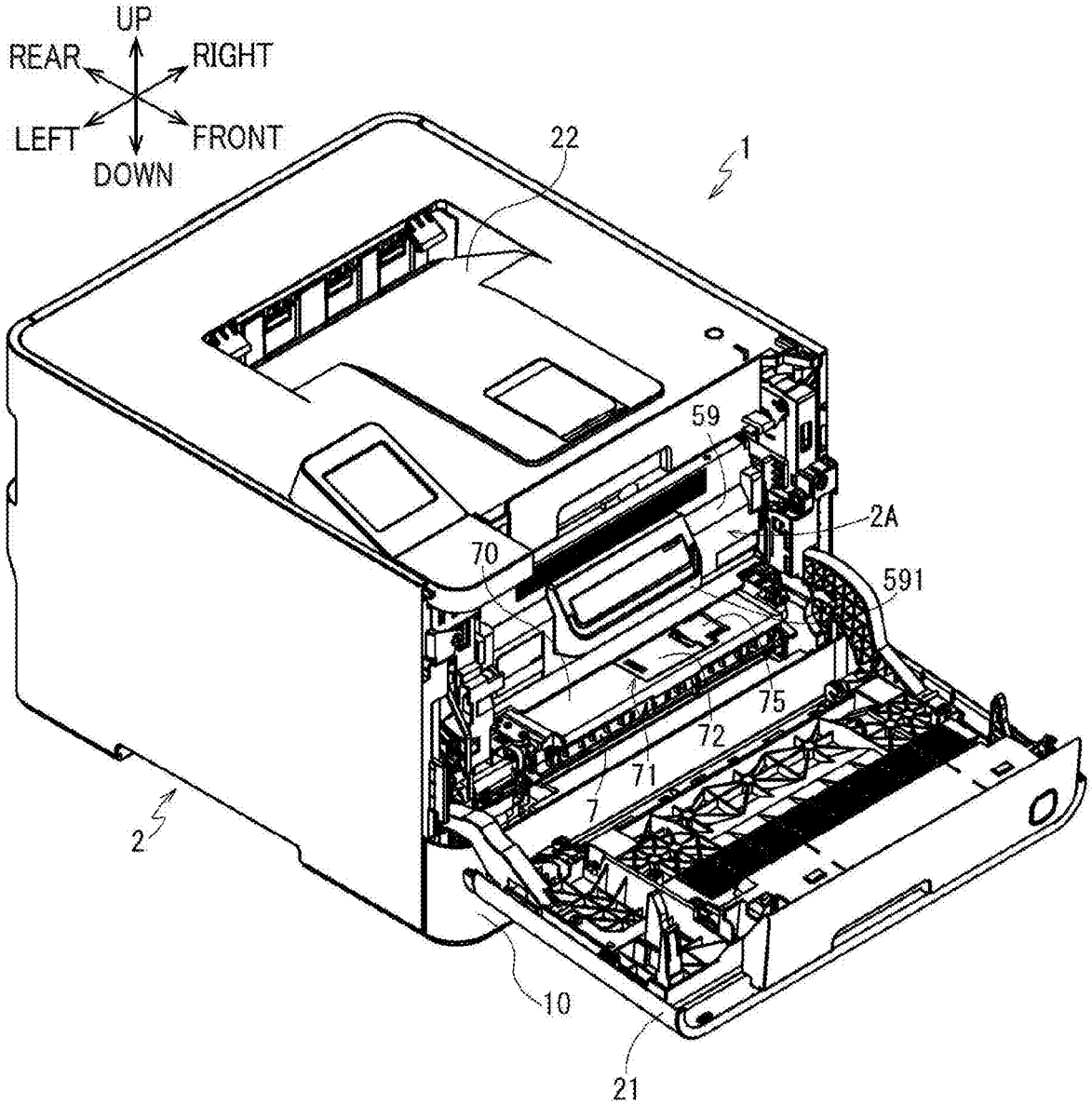
FIG. 3 a perspective view illustrating the image forming apparatus in which the front cover is at an open position.

An image forming apparatus 1 illustrated in FIGS. 1 through 3 is a color laser printer configured to form images of multiple colors on sheets S with an electro-photographic system.

In the following description, a right side, a left side, a near side, a far side, an upper side, and a lower side in FIG. 1 will be defined as a front side, a rear side, a left side, a right side, an upper side, and a lower side of the image forming apparatus 1, respectively.

As illustrated in FIGS. 1 through 3, the image forming apparatus 1 includes a main housing 2, a sheet supplying unit 3, and an image forming unit 5. The sheet supplying unit 3 includes a sheet tray 10 configured to support a sheet(s) S, and a sheet conveying unit 30 configured to convey the sheet(s) S. The image forming unit 5 is configured to form an image on the sheet S conveyed by the sheet supplying unit 3.

The main housing 2 has a substantially rectangular-parallelepiped shape, and accommodates therein the sheet supplying unit 3 and the image forming unit 5. The main housing 2 has a front surface formed with a front opening 2A, and includes a front cover 21 configured to open and close the front opening 2A. Specifically, the front cover 21 is movable between an open position (a position illustrated in FIG. 3) in which the front cover 21 opens the front opening 2A, and a closed position (a position illustrated in FIG. 2) in which the front cover 21 closes the front opening 2A.

The sheet supplying unit 3 is positioned at a lower portion inside the main housing 2. The sheet supplying unit 3 is configured to convey the sheet S supported by the sheet tray 10 toward the image forming unit 5 using the sheet conveying unit 30. The sheet tray 10 is linearly movable relative to the main housing 2 in a front-rear direction. Specifically, the sheet tray 10 is movable between an accommodated position in which the sheet tray 10 is accommodated in the main housing 2, and a separated position in which the sheet tray 10 is pulled frontward from the main housing 2.

The sheet conveying unit 30 includes a sheet supply roller 32, a separation roller 33, a separation pad 33*a*, a pair of conveying rollers 34, and a pair of registration rollers 35. A sheet conveying path P extending from the sheet tray 10 to a sheet discharge tray 22 via the image forming unit 5 is formed inside the main housing 2. The sheet S is configured to be conveyed along the sheet conveying path P in a sheet conveying direction.

The sheets S supported by the sheet tray 10 are separated one by one and are fed to the sheet conveying path P using the sheet supply roller 32, the separation roller 33, and the separation pad 33*a*. The sheet supply roller 32 is configured to supply the sheets S from the sheet tray 10 toward the image forming unit 5. The separation roller 33 and the separation pad 33*a* configure a separating mechanism for separating the sheets S on the sheet tray 10 one by one.

The sheet S fed to the sheet conveying path P is conveyed toward the image forming unit 5 by the pair of conveying rollers 34 and the pair of registration rollers 35. The pair of registration rollers 35 is configured to regulate a position of a leading edge of the conveyed sheet S and temporarily stop movement of the sheet S, and then convey the sheet S toward the image forming unit 5 at a prescribed timing.

The front cover 21 is formed with a sheet supply opening 21*a* through which the sheet S can be supplied toward the image forming unit 5. The front cover 21 supports an MP (multi-purpose) tray cover 23 that is pivotally movable about a pivot shaft 23*a* extending in a left-right direction.

By pivotally moving about the pivot shaft 23*a*, the MP tray cover 23 is movable between an open position in which the MP tray cover 23 opens the sheet supply opening 21*a*, and a closed position in which the MP tray cover 23 closes the sheet supply opening 21*a*.

The MP tray cover 23 supports an MP tray 24. The MP tray 24 is configured to support a sheet S when the MP tray cover 23 is at the open position. The sheet S supported by the MP tray 24 is configured to be supplied to the image forming unit 5 through the sheet supply opening 21*a*.

The image forming apparatus 1 further includes a sheet feeding device 7 configured to supply the sheet S on the MP tray 24 to the image forming unit 5. The sheet feeding device 7 includes a roller frame 70, a roller holder 71, a feeding roller 73, a separation roller 74, and a separation pad 741. The feeding roller 73 is configured to feed the sheet S.

The sheets S supported by the MP tray 24 are separated one by one, and fed to the sheet conveying path P by the feeding roller 73, the separation roller 74, and the separation pad 741. The sheet S fed to the sheet conveying path P is conveyed toward the image forming unit 5 by the pair of registration rollers 35.

The feeding roller 73 and the separation roller 74 are supported by the roller holder 71. The roller holder 71 includes a roller cover 72 which holds the feeding roller 73 and the separation roller 74.

The roller frame 70 is supported by the main housing 2. As illustrated in FIG. 3, the roller frame 70 is exposed to an outside of the main housing 2 in a state where the front cover 21 is at the open position. The roller holder 71 is attached to the roller frame 70.

The image forming unit 5 is positioned above the sheet supplying unit 3, and includes four toner cartridges 50 arranged in the front-rear direction and four photosensitive drums 51 provided corresponding to the toner cartridges 50. The toner cartridges 50 are provided corresponding to the colors of black, yellow, magenta, and cyan. Each of the toner cartridges 50 includes a developing roller 52.

Each of the toner cartridges 50 is supported by a drawer 59 so as to be detachable from the drawer 59. The drawer 59 is attachable to and detachable from the main housing 2 through the front opening 2A of the main housing 2 when the front cover 21 is at the open position. Specifically, the drawer 59 is movable between a first position in which the drawer 59 is positioned inside the main housing 2, and a second position in which at least a part of the drawer 59 is positioned outside of the main housing 2. The drawer 59 includes a handle 591 configured to be gripped by a user when the drawer 59 is moved between the first position and the second position. The handle 591 is positioned on a front end portion of the drawer 59.

Each of the photosensitive drums 51 has a substantially hollow cylindrical shape, and defines an axis extending in an axial direction parallel to the left-right direction. Each of the photosensitive drums 51 is rotatably supported by the drawer 59. Each of the developing rollers 52 extends in the left-right direction, and is rotatably supported by the corresponding toner cartridge 50. In other words, the drawer 59 supports the photosensitive drums 51 and the developing rollers 52. Each of the developing rollers 52 is configured to supply toner to the corresponding photosensitive drum 51.

The main housing 2 includes an exposure unit 56 configured to expose surfaces of the photosensitive drums 51 to light. The exposure unit 56 includes a laser diode, a deflector, lenses, and mirrors which are not illustrated. The exposure unit 56 is configured to emit laser beams to the photosensitive drums 51 to expose the surfaces of the photosensitive drums 51 to light.

A transfer belt 41 is positioned downward of and faces the photosensitive drums 51 with the sheet conveying path P being interposed between the transfer belt 41 and the photosensitive drums 51. The transfer belt 41 is in contact with the photosensitive drums 51. The transfer belt 41 is looped over a drive roller 42 and a driven roller 43 which is positioned frontward of the drive roller 42. Transfer rollers 44 are positioned within a space encircled by the transfer belt 41 to face the corresponding photosensitive drums 51 with the transfer belt 41 being interposed between the transfer rollers 44 and the corresponding photosensitive drums 51. The transfer belt 41, the drive roller 42, the driven roller 43, and the transfer rollers 44 configure a belt unit 40 in the image forming unit 5.

The image forming unit 5 further includes chargers 54 configured to charge the corresponding photosensitive drums 51. The chargers 54 are supported by the drawer 59. The photosensitive drums 51 uniformly charged by the corresponding chargers 54 are selectively exposed to light by the exposure unit 56. The exposure by the exposure unit 56 removes electric charges on selected areas of the surfaces of the photosensitive drums 51, thereby forming electrostatic latent images on the surfaces of the photosensitive drums 51.

Toner accommodated in the toner cartridges 50 is charged with positive polarity, and is carried on the surfaces of the developing rollers 52. A developing bias is applied to the developing rollers 52. When the electrostatic latent images formed on the photosensitive drums 51 face the corresponding developing rollers 52, toner on the surfaces of the developing rollers 52 is supplied to the electrostatic latent images because of a potential difference between the electrostatic latent images and the developing rollers 52. As a result, toner images are formed on the surfaces of the photosensitive drums 51.

After the sheet S conveyed toward the image forming unit 5 reaches the transfer belt 41, the sheet S is conveyed by the transfer belt 41 and passes through a portion between the photosensitive drums 51 and the transfer belt 41. As the sheet S faces the toner images formed on the surfaces of the photosensitive drums 51, the toner images on the photosensitive drums 51 are transferred onto the sheet S due to a transfer bias applied to the transfer rollers 44.

Note that, although the transfer belt 41 functions as a conveying belt for conveying the sheet S to which the toner images are to be transferred in the present embodiment, the transfer belt 41 may function as an intermediate transfer belt to which the toner images are to be transferred. In this case, the toner images that have been transferred onto the intermediate transfer belt are further transferred onto the sheet S.

The sheet S to which the toner images have been transferred is conveyed to a fixing unit 60. The fixing unit 60 includes a heat roller 61, and a pressure roller 62 in pressure contact with the heat roller 61. The toner images on the sheet S are thermally fixed to the sheet S when the sheet S passes through a portion between the heat roller 61 and the pressure roller 62. That is, the fixing unit 60 is configured to fix the toner images to the sheet S.

The sheet S to which the toner images have been thermally fixed is conveyed toward a portion downstream of the fixing unit 60 in the sheet conveying direction. The sheet S is then conveyed by a pair of intermediate discharge rollers 63 and a pair of discharge rollers 64, which is positioned downstream of the intermediate discharge rollers 63 in the sheet conveying direction, and is finally discharged onto the sheet discharge tray 22.

In the image forming apparatus 1, the drawer 59, and the toner cartridges 50, the photosensitive drums 51, the chargers 54, and the like which are supported by the drawer 59 configure a process unit PU configured to form toner images on the sheet S. In the process unit PU, the drawer 59 supports the photosensitive drums 51. Alternatively, the toner cartridges 50 may support the corresponding photosensitive drums 51. Further, the process unit PU may further include the fixing unit 60. Further, the drawer 59 may be omitted from the process unit PU. In this case, the process unit PU including the photosensitive drums 51 and the toner cartridges 50 may be directly attachable to and detachable from the main housing 2.

[Sheet Feeding Device]

As illustrated in FIGS. 4 through 7, the sheet feeding device 7 further includes a holder stopper 75 in addition to the roller frame 70, the roller holder 71, the feeding roller 73, and the separation roller 74 which are describe above. The roller frame 70 is an example of the "frame", the roller holder 71 is an example of the "holder", and the holder stopper 75 is an example of the "stopper".

(Roller Frame)

The roller frame 70 is a plate-like member elongated in the left-right direction. The roller frame 70 has a first surface 70A exposed to the outside of the main housing 2 when the front cover 21 is at the open position, and a second surface 70B which is an opposite surface of the first surface 70A. The first surface 70A faces upward, and the second surface 70B faces downward.

The roller frame 70 has a support opening 70*a* and a support groove 70*b*. The support opening 70*a* penetrates the roller frame 70 in an up-down direction and configured to support the roller holder 71. The support groove 70*b* is recessed downward from the first surface 70A and configured to support the holder stopper 75. The support opening 70*a* and the support groove 70*b* are formed continuously with each other in the left-right direction. The support opening 70*a* is positioned leftward of the support groove 70*b*.

A shaft 76 for rotating the separation roller 74 is attached to the second surface 70B of the roller frame 70 so as to be rotatable. The shaft 76 extends in the left-right direction. The shaft 76 has a left end portion positioned at a left end portion of the roller frame 70, and has a right end portion 76*a* facing a left end portion of the support opening 70*a*. The shaft 76 is driven to rotate upon receipt of a driving force from a driving source (not illustrated).

The roller frame 70 includes rails 701 and 702 provided in the support opening 70*a*. Each of the rails 701 and 702 extends in the left-right direction. The rail 701 protrudes rearward from a front inner peripheral surface among inner peripheral surfaces defining the support opening 70*a*. The rail 702 protrudes frontward from a rear inner peripheral surface among the inner peripheral surfaces defining the support opening 70*a*. The rails 701 and 702 are configured to support the roller cover 72 from below so that the roller cover 72 is movable in the left-right direction.

The roller frame 70 also includes a bottom wall 703, a front wall 704, and a rear wall 705 which define the support groove 70*b*. A supporting protrusion 706 protruding in the front-rear direction is provided on each of the front wall 704 and the rear wall 705. The supporting protrusion 706 provided on the front wall 704 protrudes rearward from the front wall 704. The supporting protrusion 706 provided on the rear wall 705 protrudes frontward from the rear wall 705.

(Roller Holder)

As described above, the roller holder 71 includes the roller cover 72 which holds the feeding roller 73 and the separation roller 74. The feeding roller 73 and the separation roller 74 are arranged while an axial direction of the feeding roller 73 and the separation roller 74 is parallel to the left-right direction. That is, each of the feeding roller 73 and the separation roller 74 is held by the roller cover 72 so as to be rotatable about an axis extending in the axial direction, i.e., the left-right direction. The roller cover 72 is an example of the "cover".

The separation roller 74 includes a connecting portion 74*a* configured to be connected to the shaft 76. The connecting portion 74*a* is formed in a recess that is recessed rightward from a left end portion of the separation roller 74.

In a state where the roller holder 71 is attached to the roller frame 70 and positioned at a non-detachable position (described later), the right end portion 76*a* of the shaft 76 is inserted in the connecting portion 74*a* of the separation roller 74, whereby the shaft 76 and the separation roller 74 are connected to each other so as to be rotatable together.

The roller holder 71 includes a gear train 77 provided over the separation roller 74 and the feeding roller 73 so that the separation roller 74 and the feeding roller 73 are connected to each other. Upon rotation of the separation roller 74, a driving force is transmitted from the separation roller 74 to the feeding roller 73 through the gear train 77 to rotate the feeding roller 73.

The roller holder 71 is attached to the support opening 70*a* of the roller frame 70 so as to be detachable therefrom. Specifically, while the roller cover 72 of the roller holder 71 is supported by the rails 701 and 702 in the support opening 70*a* (i.e., while the roller holder 71 is attached to the roller frame 70), the roller holder 71 is movable relative to the roller frame 70 in the left-right direction, which is the axial direction of the feeding roller 73, between an non-detachable position in which the roller holder 71 is non-detachable from the roller frame 70, and a detachable position in which the roller holder 71 is attachable from the roller frame 70.

In the present embodiment, the roller holder 71 is moved from the non-detachable position to the detachable position by moving rightward from the non-detachable position. A direction directed from the non-detachable position to the detachable position will also be referred to as "specific direction".

The roller cover 72 is positioned above the feeding roller 73 and the separation roller 74. In the state where the roller holder 71 is attached to the roller frame 70, an upper surface of the roller cover 72 is at the same position in the up-down direction as an upper surface of the roller frame 70. That is, the upper surface of the roller frame 70 is flush with the upper surface of the roller cover 72 of the roller holder 71 attached to the roller frame 70.

The roller cover 72 includes a plurality of ribs 721 protruding upward from the upper surface of the roller cover 72. The ribs 721 extend in the front-rear direction. The ribs 721 are positioned on a left end portion of the roller cover 72 to be arranged in the left-right direction. The ribs 721 are used for hooking a user's finger when moving the roller holder 71 in the left-right direction. By applying a force directed in the left-right direction using the finger while the finger is hooked to the ribs 721, the roller holder 71 can be moved easily in the left-right direction.

The roller cover 72 is formed with a recess 722 recessed downward from the upper surface of the roller cover 72. The recess 722 is positioned on a right end portion of the roller cover 72, which is an end portion of the roller cover 72 in the left-right direction that is positioned closer to the holder stopper 75 than the left end portion of the roller cover 72 is to the holder stopper 75.

(Holder Stopper)

The holder stopper 75 is positioned juxtaposed with the roller holder 71 in the left-right direction, which is a moving direction in which the roller holder 71 is movable, in a state where the holder stopper 75 is at a restricting position (described later) and the roller holder 71 is at the non-detachable position. Specifically, the holder stopper 75 is positioned rightward of the roller holder 71 in this state.

The holder stopper 75 is supported by the support groove 70*b* of the roller frame 70. The holder stopper 75 is pivotally movable about a pivot axis R extending in the front-rear direction that is orthogonal to the axial direction of the feeding roller 73. The pivot axis R is positioned in a right end portion of the holder stopper 75.

By pivotally moving about the pivot axis R, the holder stopper 75 is movable between the restricting position (a position illustrated in FIG. 5) in which the holder stopper 75 restricts the roller holder 71 from moving in the specific direction from the non-detachable position to the detachable position and an allowing position (a position illustrated in FIG. 6) in which the holder stopper 75 allows the roller holder 71 to be moved in the specific direction from the non-detachable position to the detachable position.

The holder stopper 75 includes an upper plate 751, a pair of side plates 752 (a front side plate 752 and a rear side plate 752), and a pair of hooks 753 (a front hook 753 and a rear hook 753).

The upper plate 751 is a flat plate-like member. The upper plate 751 includes a rib 751*a* which protrudes from the upper plate 751 in a direction orthogonal to a moving direction in which the holder stopper 75 is movable between the restricting position and the allowing position about the pivot axis R. The rib 751*a* protrudes leftward from a left end portion of the upper plate 751 in a state where the holder stopper 75 is at the restricting position. The rib 751*a* is positioned on a left end portion of the holder stopper 75, which is an end portion of the holder stopper 75 in the left-right direction that is positioned closer to the roller holder 71 than a right end portion of the holder stopper 75 is to the roller holder 71.

Figure 4:
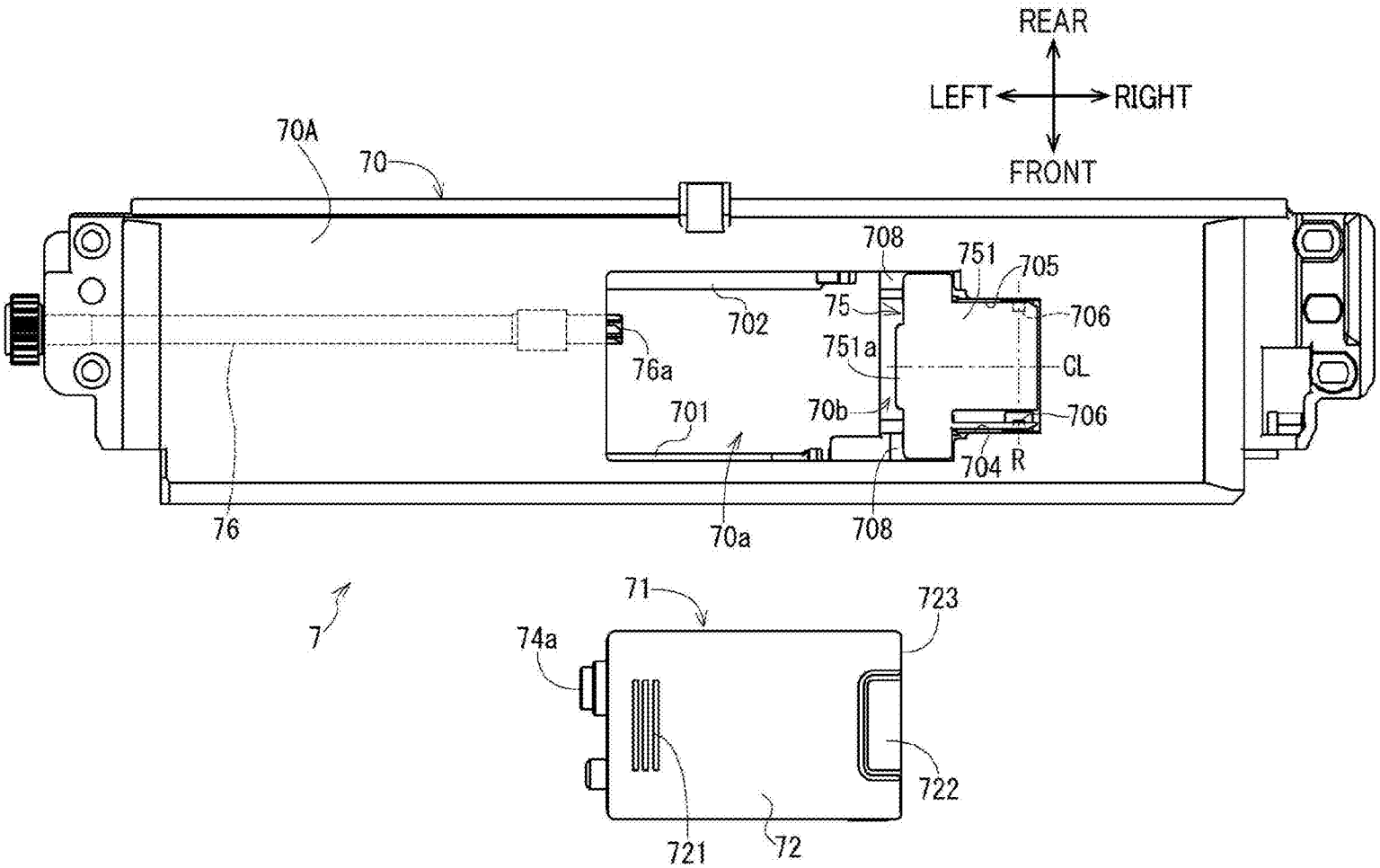
FIG. 4 is a plan view illustrating a roller frame, a roller holder, and a holder stopper.

The rib 751*a* is provided on a center portion in the front-rear direction of the upper plate 751, for example. As the rib 751*a* is positioned at the center portion in the front-rear direction of the upper plate 751 as illustrated in FIG. 4, a center in the front-rear direction of the rib 751*a* is coincident with a center line CL in the front-rear direction of the holder stopper 75.

The rib 751*a* is usable by the user to move the holder stopper 75 in the moving direction thereof between the restricting position and the allowing position. Specifically, the holder stopper 75 can be moved in the moving direction thereof by hooking the user's finger to the rib 751*a* and applying a force directed in the moving direction of the holder stopper 75. Hooking the finger to the rib 751*a* and moving the holder stopper 75 using the finger can facilitate the movement of the holder stopper 75 between the restricting position and the allowing position.

With respect to the left-right direction, the rib 751*a* is positioned at the end portion of the holder stopper 75 that is closer to the roller holder 71 (i.e., the left end portion) at the restricting position of the holder stopper 75, and the recess 722 of the roller holder 71 is positioned at the end portion of the roller holder 71 that is closer to the holder stopper 75 (i.e., the right end portion). That is, the recess 722 is at a position juxtaposed with the rib 751*a* in the left-right direction, which is the moving direction of the roller holder 71, in a state where the holder stopper 75 is at the restricting position and the roller holder 71 is at the non-detachable position. Hence, the rib 751*a* of the holder stopper 75 and the recess 722 of the roller holder 71 face each other to be juxtaposed with each other in a state where the holder stopper 75 is at the restricting position and the roller holder 71 is at the non-detachable position. The recess 722 has a shape allowing the user's finger to easily enter therein.

With such a configuration, in order to hook the finger to the rib 751*a* to move the holder stopper 75 at the restricting position toward the allowing position, the finger hooked to the rib 751*a* can enter the recess 722 of the roller holder 71, thereby enabling the operation for moving the holder stopper 75 to be easily performed.

Further, the roller holder 71 is formed with the recess 722 juxtaposed with the rib 751*a* in the moving direction of the roller holder 71 in a state where the holder stopper 75 is at the restricting position and the roller holder 71 is at the non-detachable position. With this arrangement, since the user's finger can be hooked to the rib 751*a* while the user's finger enters the recess 722, the operation for hooking the finger to the rib 751*a* can be easily performed.

The front side plate 752 and the rear side plate 752 protrude downward from a front end portion and a rear end portion of the upper plate 751, respectively, in a state where the holder stopper 75 is at the restricting position. Each of the front side plate 752 and the rear side plate 752 is formed with a support hole 752*a* which penetrates the corresponding side plate 752 in the front-rear direction. The supporting protrusion 706 on the front wall 704 is inserted in the support hole 752*a* of the front side plate 752, and the supporting protrusion 706 on the rear wall 705 is inserted in the support hole 752*a* of the rear side plate 752. By virtue of insertion of the supporting protrusions 706 in the corresponding support holes 752*a*, the holder stopper 75 is supported at the support groove 70*b* so as to be pivotally movable about the pivot axis R.

Each of the front hook 753 and the rear hook 753 includes an elastic piece 753*a* and an engagement protrusion 753*b*, and has a sloped surface 753*c*. Each of the elastic pieces 753*a* extends from the corresponding side plate 752 in a direction orthogonal to the pivot axis R. Each of the elastic pieces 753*a* protrudes leftward from the corresponding side plate 752 in a state where the holder stopper 75 is at the restricting position.

Each of the engagement protrusions 753*b* protrudes from the corresponding elastic piece 753*a* in the front-rear direction. Each of the engagement protrusions 753*b* is positioned in a left end portion of the corresponding elastic piece 753*a* in a state where the holder stopper 75 is at the restricting position.

Specifically, the engagement protrusion 753*b* of the front hook 753 protrudes frontward from the elastic piece 753*a* of the front hook 753. The engagement protrusion 753*b* of the rear hook 753 protrudes rearward from the elastic piece 753*a* of the rear hook 753.

Each of the front wall 704 and the rear wall 705 which define the support groove 70*b* is formed with an engagement groove 707. The engagement protrusions 753*b* of the front hook 753 and the rear hook 753 are configured to be engaged with the corresponding engagement grooves 707. Specifically, the engagement protrusion 753*b* of the front hook 753 is configured to be engaged with the engagement groove 707 of the front wall 704, and the engagement protrusion 753*b* of the rear hook 753 is configured to be engaged with the engagement groove 707 of the rear wall 705.

In a state where the holder stopper 75 is at the restricting position, the engagement protrusions 753*b* and the corresponding engagement grooves 707 are in engagement with each other to maintain the holder stopper 75 at the restricting position. In other words, the hooks 753 are configured to be engaged with the roller frame 70, and are configured to fix the holder stopper 75 to the roller frame 70 at the restricting position by the engagement thereof with the roller frame 70.

Stepped portions 708 are formed in the support groove 70*b* at positions upward of the engagement grooves 707. The stepped portions 708 are configured to abut on the corresponding engagement protrusion 753*b* of the holder stopper 75 when the holder stopper 75 is positioned at a position between the restricting position and the allowing position. That is, the engagement protrusions 753*b* disengaged from the corresponding engagement grooves 707 during the movement of the holder stopper 75 from the restricting position toward the allowing position are configured to abut on the stepped portion 708 from above. Further, also during the movement of the holder stopper 75 from the allowing position toward the restricting position, the engagement protrusions 753*b* are configured to abut on the corresponding stepped portions 708 from above.

Upon abutment of the engagement protrusions 753*b* with the stepped portions 708 due to the deadweight of the holder stopper 75, the movement of the holder stopper 75 from the allowing position toward the restricting position is stopped. The holder stopper 75 is at an intermediate position between the restricting position and the allowing position in a state where the movement of the holder stopper 75 is stopped by the abutment of the engagement protrusions 753*b* with the stepped portions 708.

In this way, the holder stopper 75 is configured to, when moving the allowing position between the restricting position, pass through the intermediate position between the allowing position and the restriction position. The holder stopper 75 at the intermediate position is restricted from moving to the restricting position under its own weight by the abutment of the hooks 753 on the corresponding stepped portions 708 of the roller frame 70 when moving from the allowing position.

Further, in accordance with the movement of the holder stopper 75, each of the hooks 753 is configured to, when moving between the allowing position and the restricting position, pass through the intermediate position between the allowing position and the restriction position. The hooks 753 at the intermediate position are restricted from moving to the restricting position by the abutment of the hooks 753 on the corresponding stepped portions 708 of the roller frame 70 when the holder stopper 75 moves from the allowing position by its own weight.

Figure 8:
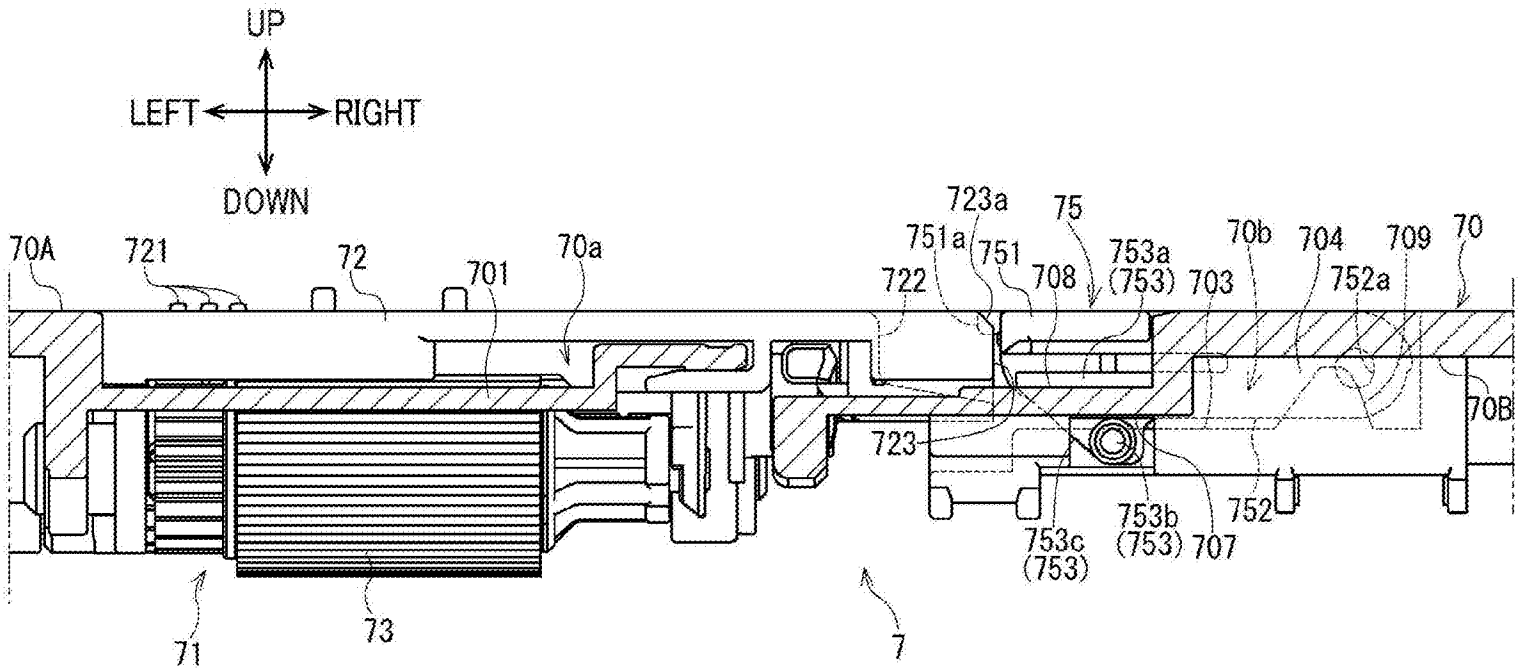
FIG. 8 is a front cross-sectional view illustrating the roller frame, the roller holder positioned at the non-detachable position, and the holder stopper positioned at the restricting position.

Each of the sloped surfaces 753*c* is provided at the left end portion of the corresponding elastic piece 753*a*. Each of the sloped surfaces 753*c* is inclined relative to the left-right direction which is the moving direction of the roller holder 71 both in a state where the holder stopper 75 is at the restricting position (see FIG. 8) and in a state where the holder stopper 75 is at the intermediate position (see FIG. 9). Each of the sloped surfaces 753*c* is inclined diagonally upward as extending leftward. That is, each of the sloped surfaces 753*c* is inclined diagonally downward toward the detachable position from the non-detachable position of the roller holder 71, i.e., toward downstream side from the upstream side in the specific direction.

Figure 9:
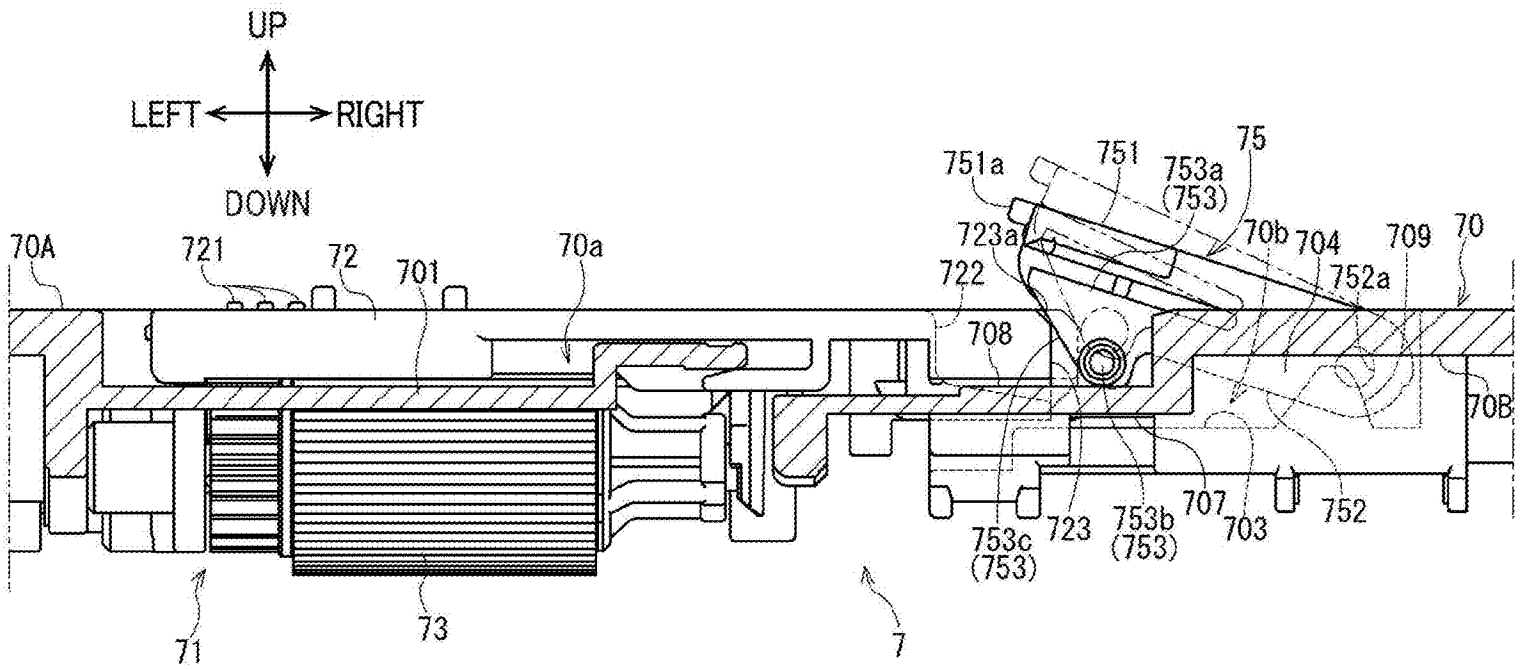
FIG. 9 is a front cross-sectional view illustrating the roller frame, the roller holder positioned at a position between the non-detachable position and a detachable position, and the holder stopper positioned at an intermediate position.

Each of the sloped surfaces 753*c* is configured to contact the roller holder 71 positioned between the non-detachable position and the detachable position in a state where the holder stopper 75 is at the intermediate position, for example. Specifically, as illustrated in FIG. 9, each of the sloped surfaces 753*c* is configured to contact a right end 723 of the roller cover 72 of the roller holder 71. The right end 723 is the downstream end of the roller cover 72 in the specific direction from the non-detachable position toward the detachable position.

In a case where the roller holder 71 is moved toward the detachable position while the sloped surfaces 753*c* contact the right end 723 of the roller cover 72, the holder stopper 75 is pressed by the roller holder 71 to be pivotally moved toward the allowing position as indicated by two-dotted chain line in FIG. 9.

In this case, the right end 723 of the roller cover 72 is not caught by the sloped surfaces 753*c*, since the sloped surfaces 753*c* are inclined diagonally upward as extending leftward. Hence, the holder stopper 75 can be smoothly moved toward the allowing position in accordance with the movement of the roller holder 71.

Further, a chamfered portion 723*a* is formed in an upper end portion of the right end 723, which is a portion on which the sloped surfaces 753*c* are configured to abut. Providing the chamfered portion 723*a* enhances the movement of the right end 723 of the roller cover 72 relative to the sloped surfaces 753*c*, whereby the movement of the holder stopper 75 toward the allowing position can be smoothly performed in accordance with the movement of the roller holder 71.

In a state where the holder stopper 75 is at the restricting position, the holder stopper 75 is accommodated in the support groove 70*b*. An upper surface of the upper plate 751 of the holder stopper 75 positioned at the restricting position is at the same position in the up-down direction as the upper surface of the roller frame 70. That is, the upper surface of the holder stopper 75 positioned at the restricting position is flush with the upper surface of the roller frame 70.

The holder stopper 75 protrudes further upward relative to the support groove 70*b* in a state where the holder stopper 75 is at the allowing position and in a state where the holder stopper 75 is at the intermediate position. An amount by which the holder stopper 75 protrudes relative to the support groove 70*b* in a state where the holder stopper 75 is at the intermediate position is smaller than that in a state where the holder stopper 75 is at the allowing position.

Figure 6:
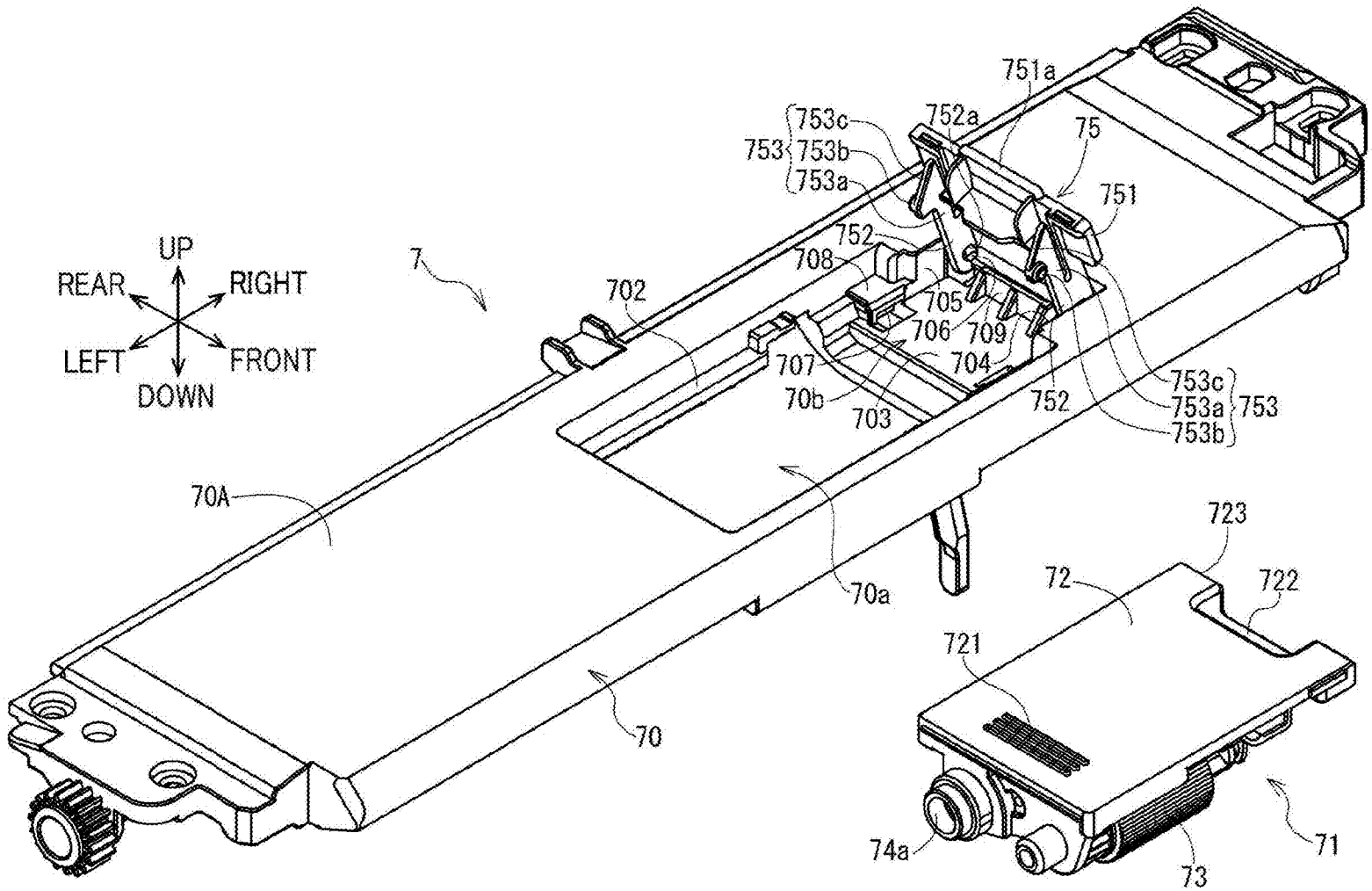
FIG. 6 is a perspective view illustrating the roller frame, the roller holder detached from the roller frame, and the holder stopper positioned at an allowing position.
Figure 7:
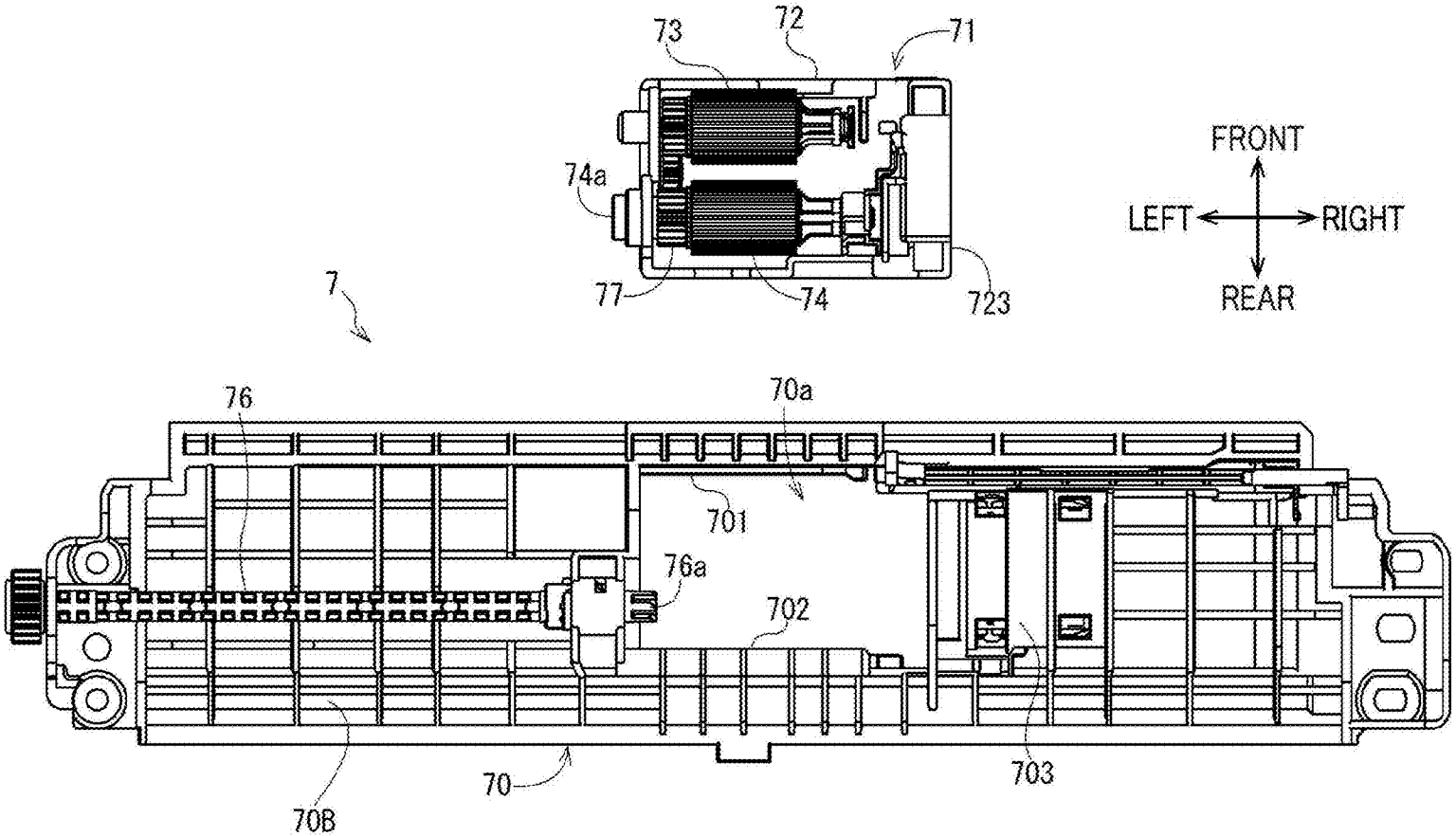
FIG. 7 is a bottom view illustrating the roller frame and the roller holder.
Figure 10:
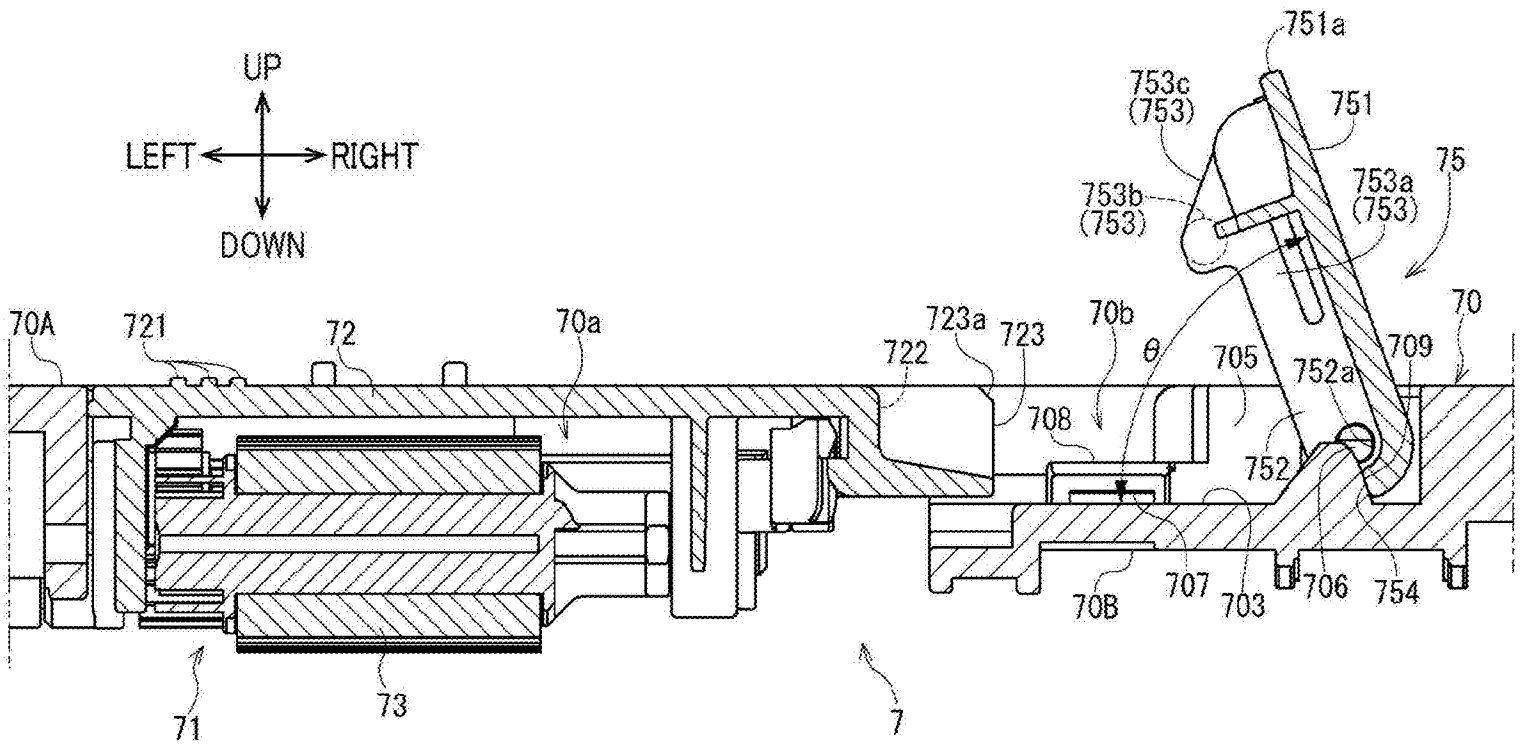
FIG. 10 is a front cross-sectional view illustrating the roller frame, the roller holder positioned at the non-detachable position, and the holder stopper positioned at the allowing position.

As illustrated in FIGS. 6 and 10, the roller frame 70 also includes a restricting piece 709 configured to contact the holder stopper 75 positioned at the allowing position to restrict the holder stopper 75 from moving from the allowing position in a direction away from the restricting position. The restricting piece 709 is a protrusion protruding upward form the bottom wall 703 defining the support groove 70*b*.

In the meantime, the holder stopper 75 has a restriction surface 754 configured to abut on the restricting piece 709 when the holder stopper 75 has been moved to the allowing position. The restriction surface 754 is provided at a right end portion of the upper plate 751 of the holder stopper 75. The restriction surface 754 contacts the restricting piece 709 when the holder stopper 75 has been moved to the allowing position so that further movement of the holder stopper 75 in the direction away from the restricting position is restricted. Since the roller frame 70 includes the restricting piece 709, the roller frame 70 can securely stop the holder stopper 75 at the allowing position.

In a state where the holder stopper 75 is at the allowing position, an angle θ between an upper surface of the bottom wall 703 and the upper plate 751 of the holder stopper 75 in abutment with the restricting piece 709 is an acute angle. The upper surface of the bottom wall 703 extends both in the left-right direction and in the front-rear direction, and is an example of the "horizontal plane".

In this way, since the angle θ defined between the upper surface (i.e., the horizontal plane) of the bottom wall 703 and the holder stopper 75 positioned at the allowing position is an acute angle, the holder stopper 75 is moved back toward the restricting position due to its own weight in a case where the user's finger is released from the holder stopper 75 after the holder stopper 75 reaches the allowing position. Hence, the amount by which the holder stopper 75 protrudes relative to the roller frame 70 can be reduced in comparison with the amount by which the holder stopper 75 protrudes in a state where the holder stopper 75 is at the allowing position.

[Operations of Roller Holder and Holder Stopper]

(Operation for Attaching Roller Holder to Roller Frame)

Figure 11:
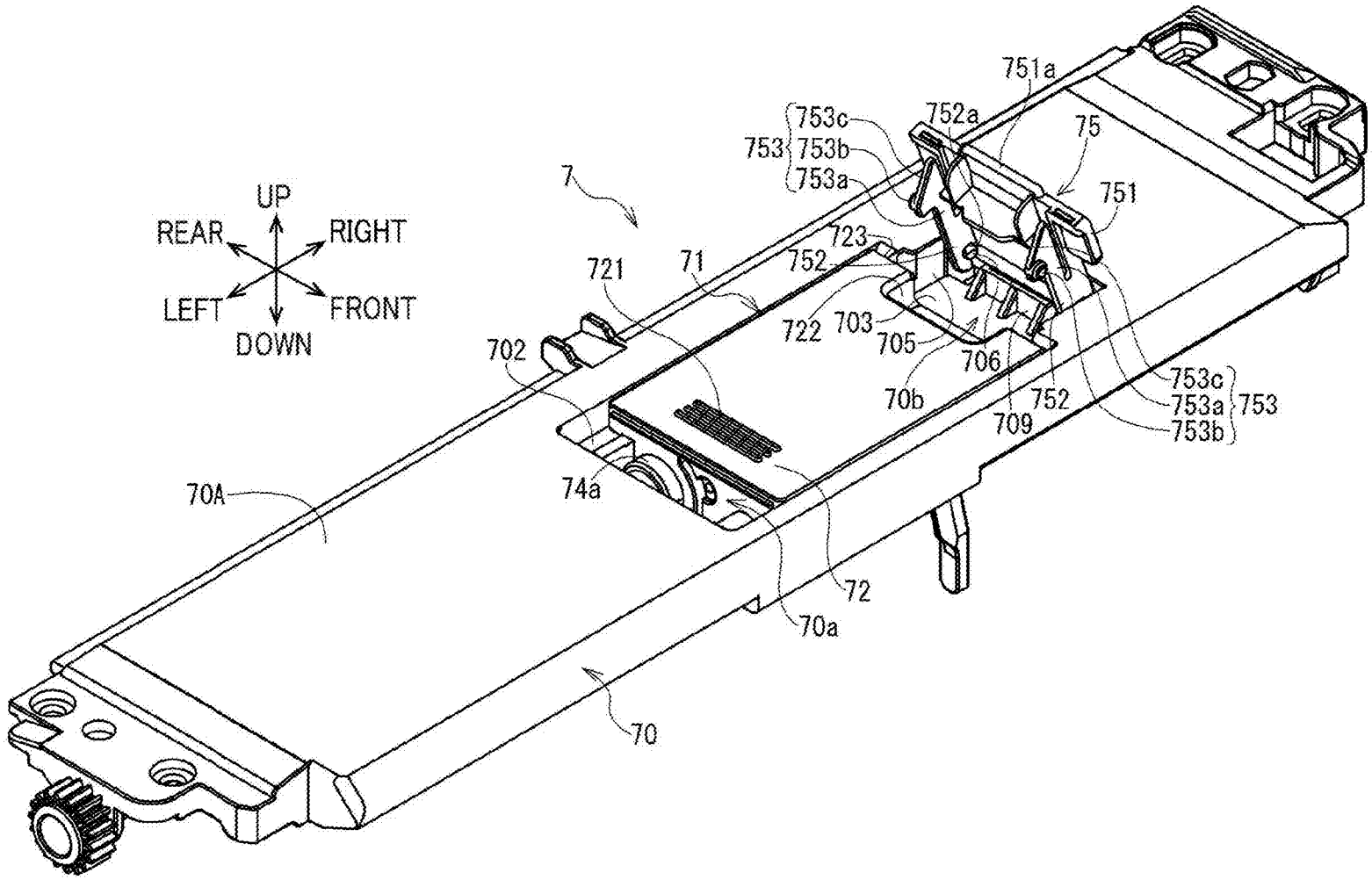
FIG. 11 is a perspective view illustrating the roller frame, the roller holder positioned at the detachable position, and the holder stopper positioned at the allowing position.

In order to attach the roller holder 71 to the roller frame 70, in a state where the holder stopper 75 is at the allowing position as illustrated in FIG. 6, the roller holder 71 is mounted in the support opening 70*a* of the roller frame 70 so that the roller holder 71 is positioned at the detachable position, as illustrated in FIG. 11. The roller holder 71 is supported by the rails 701 and 702 in the support opening 70*a* while the roller holder 71 is at the detachable position in the support opening 70*a*.

Figure 12:
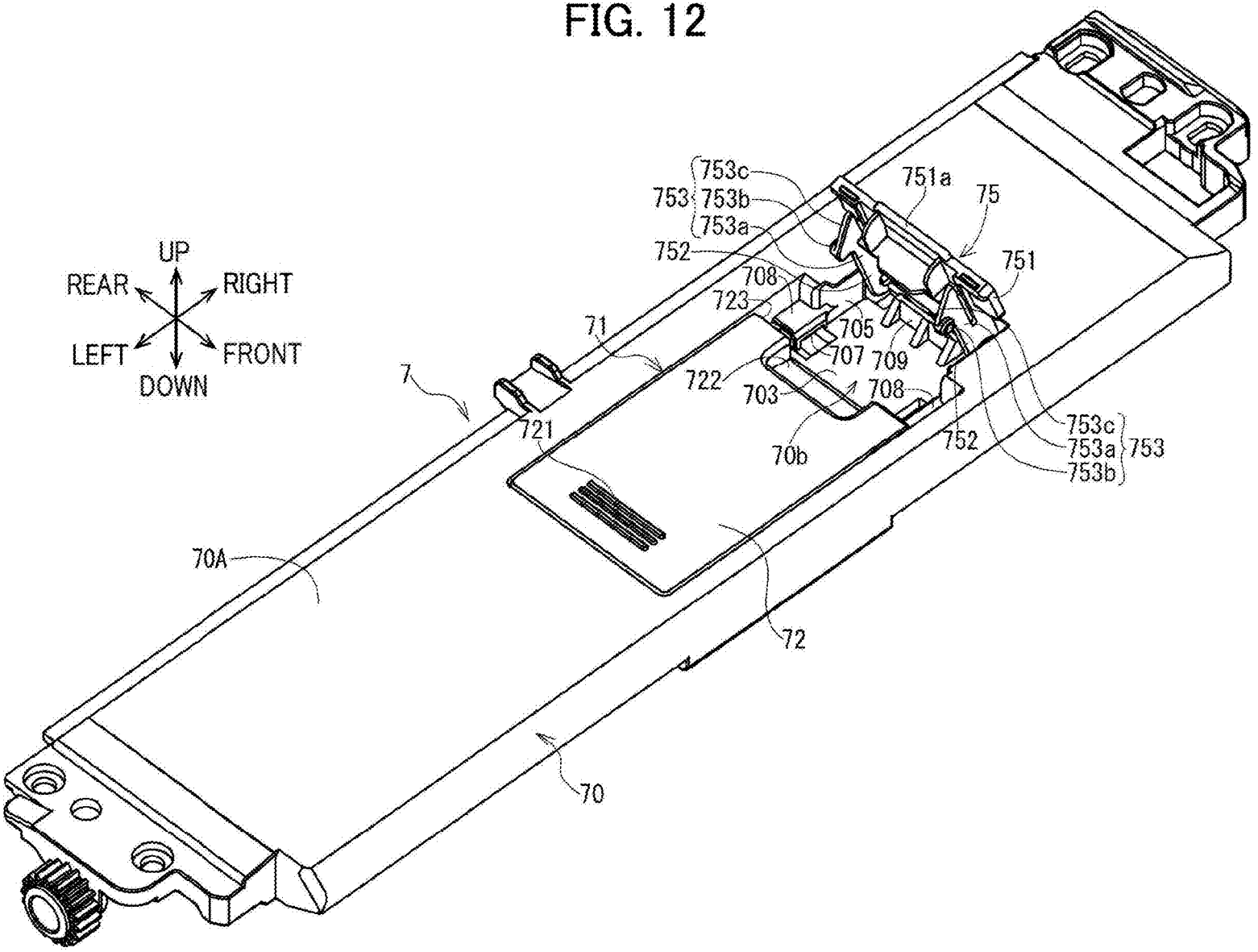
FIG. 12 is a perspective view illustrating the roller frame, the roller holder positioned at the non-detachable position, and the holder stopper positioned at the allowing position.

Next, as illustrated in FIG. 12, the roller holder 71 is slidingly moved leftward on the rails 701 and 702 until the roller holder 71 reaches the non-detachable position. Since the moving direction of the roller holder 71 is parallel to the axial direction of the separation roller 74, the connecting portion 74*a* of the separation roller 74 is brought into connection with the right end portion 76*a* of the shaft 76 in accordance with the movement of the roller holder 71. In a state where the roller holder 71 is at the non-detachable position, by the connection between the separation roller 74 and the shaft 76, the roller holder 71 is fixed to the roller frame 70 so as not to be detachable from the roller frame 70.

Figure 5:
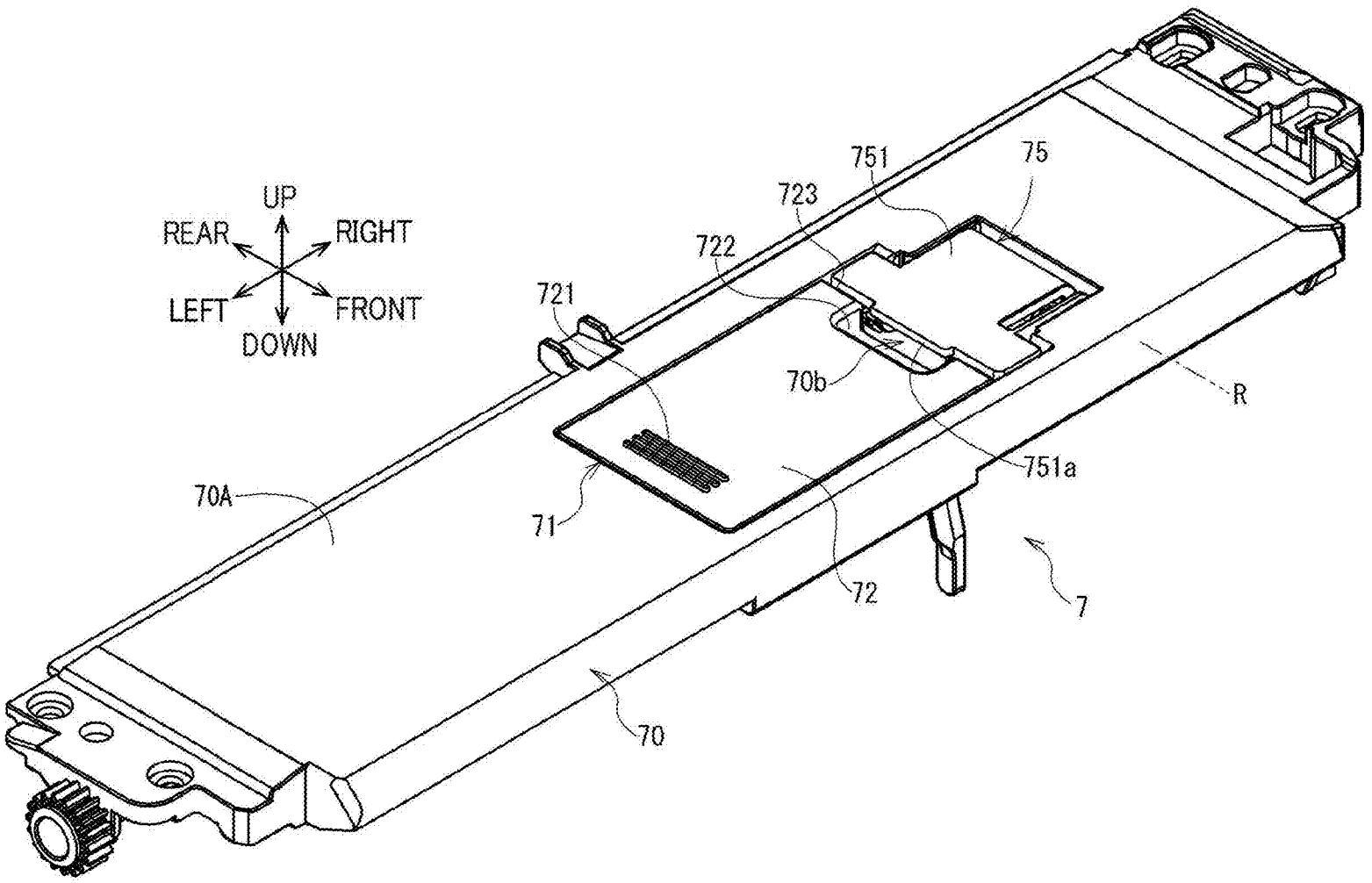
FIG. 5 is a perspective view illustrating the roller frame, the roller holder positioned at a non-detachable position, and the holder stopper positioned at a restricting position.

After the roller holder 71 has been moved to the non-detachable position, the holder stopper 75 is pivotally moved to the restricting position as illustrated in FIG. 5. In this case, for example, the user releases the user's hand from the holder stopper 75 that is positioned at the allowing position to allow the holder stopper 75 to be pivotally moved to the intermediate position by its own weight, and then the user applies a force directed toward the restricting position to the holder stopper 75, thereby causing the holder stopper 75 to be moved to the restricting position.

In a state where the holder stopper 75 is at the intermediate position as a result of the movement by its own weight, the engagement protrusions 753*b* of the hooks 753 are in contact with the corresponding stepped portions 708 of the roller frame 70. When the user applies a force directed toward the restricting position to the holder stopper 75 in this state, the force allows the elastic pieces 753*a* of the hooks 753 to be elastically deformed so that the contact between the engagement protrusions 753*b* and the stepped portions 708 is released.

Thereafter, the engagement protrusions 753*b* of the hooks 753 are brought into engagement with the corresponding engagement grooves 707 of the roller frame 70. The position of the holder stopper 75 is fixed to the restricting position by the hooks 753 in a state where the engagement protrusions 753*b* are in engagement with the corresponding engagement grooves 707.

Incidentally, in a case where the roller holder 71 does not reach the non-detachable position when moving the holder stopper 75 from the intermediate position toward the restricting position, the sloped surfaces 753*c* of the holder stopper 75 positioned at the intermediate position make contact with the right end of the roller holder 71. Accordingly, in accordance with the movement of the holder stopper 75 toward the restricting position, the roller holder 71 is pressed toward the non-detachable position by the sloped surfaces 753*c* and can be moved to the non-detachable position.

In a state where the roller holder 71 is at the non-detachable position and the holder stopper 75 is at the restricting position, the right end 723 of the roller cover 72 of the roller holder 71 faces and is juxtaposed with the left end of the upper plate 751 of the holder stopper 75. Hence, if the roller holder 71 positioned at the non-detachable position inadvertently attempts to be moved toward the detachable position, the right end 723 of the roller cover 72 contacts the holder stopper 75, whereby the movement of the roller holder 71 is restricted.

Further, since the position of the holder stopper 75 is fixed at the restricting position by the hooks 753, the holder stopper 75 does not move toward the allowing position even if the holder stopper 75 is pressed rightward by the roller holder 71. Accordingly, the roller holder 71 can be maintained at the non-detachable position.

(Operation for Detaching Roller Holder from Roller Frame)

In order to detach the roller holder 71 from the roller frame 70, in a state where the holder stopper 75 is at the restricting position illustrated in FIG. 5, the user's finger is hooked to the rib 751*a* of the holder stopper 75 and the holder stopper 75 is moved toward the allowing position. The engagement between the engagement protrusions 753*b* of the hooks 753 and the engagement grooves 707 of the roller frame 70 is released due to the movement of the holder stopper 75 toward the allowing position.

Specifically, the elastic pieces 753*a* of the hooks 753 are elastically deformed by hooking the finger to the rib 751*a* of the holder stopper 75 positioned at the restricting position and applying a force directed toward the allowing position to the holder stopper 75. As a result, the engagement protrusions 753*b* and the engagement grooves 707 of the roller frame 70 are disengaged from each other.

Figure 13:
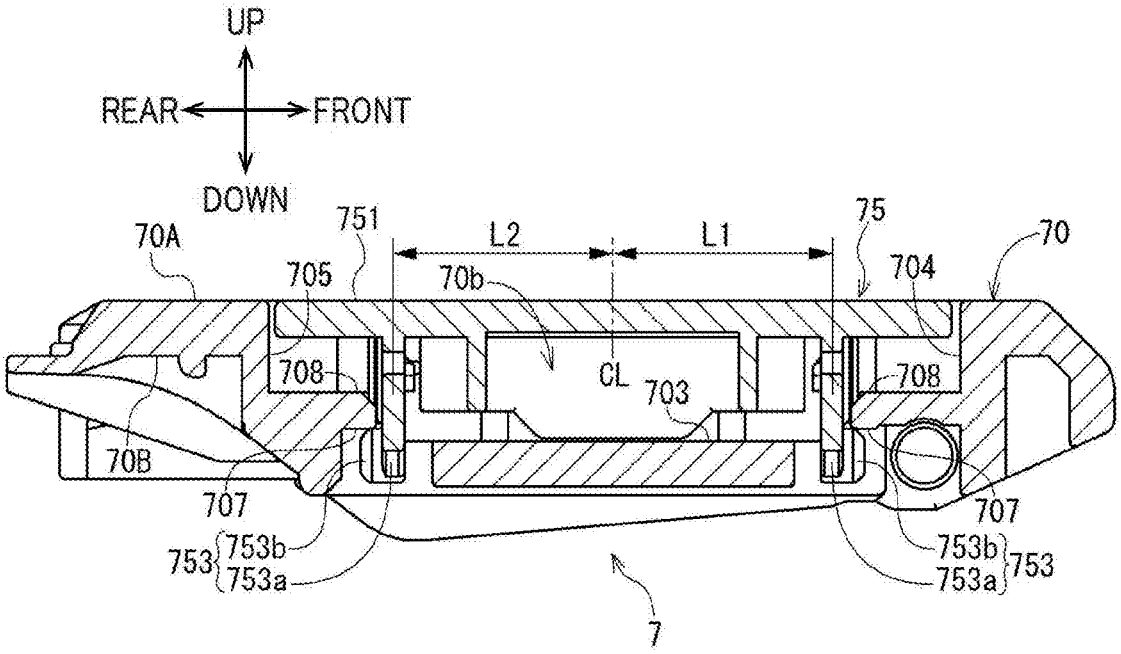
FIG. 13 is a side cross-sectional view illustrating the roller frame and the holder stopper positioned at the restricting position.

Further, the hooks 753 are respectively provided at the front end portion and rear end portion of the holder stopper 75 so that a distance L1 in the front-rear direction from the center line CL to the front hook 753 is equal to a distance L2 in the front-rear direction from the center line CL to the rear hook 753, as illustrated in FIG. 13.

With this positional relationship, since the rib 751*a* of the holder stopper 75 is provided at the center in the front-rear direction of the upper plate 751, the force directed toward the allowing position can be uniformly applied to the front hook 753 and to the rear hook 753 when the finger is hooked to the rib 751*a*. Accordingly, the engagement between the engagement protrusion 753*b* of the front hook 753 and the front engagement groove 707, and the engagement between the engagement protrusion 753*b* of the rear hook 753 and the rear engagement groove 707 can be smoothly released.

After the disengagement of the engagement protrusions 753*b* of the holder stopper 75 from the engagement grooves 707 of the roller frame 70 have been completed, the user moves the holder stopper 75 to the allowing position or to a position between the intermediate position and the allowing position, and then releases the user's hand from the holder stopper 75. As the user releases the user's hand from the holder stopper 75, the holder stopper 75 is moved back to the intermediate position by its own weight, as illustrated in FIG. 9. That is, the hooks 753 of the holder stopper 75 are also moved to the intermediate position.

When the user moves the roller holder 71 from the non-detachable position toward the detachable position in this state, the right end 723 of the roller cover 72 is brought into contact with the sloped surfaces 753*c* of the holder stopper 75.

The roller holder 71 presses the sloped surfaces 753*c* in a direction toward the detachable position of the roller holder 71 (i.e., rightward) so that the holder stopper 75 urged by the roller holder 71 is moved from the intermediate position toward the allowing position. The movement of the holder stopper 75 toward the allowing position allows the roller holder 71 to be moved to the detachable position. In a state where the roller holder 71 is at the detachable position, the roller holder 71 is allowed to be detached from the roller frame 70, since the connecting portion 74*a* of the separation roller 74 is no longer connected to the right end portion 76*a* of the shaft 76. By raising the roller holder 71 up that has been moved to the detachable position, the roller holder 71 can be detached from the roller frame 70.

In this way, when the roller holder 71 is detached from the roller frame 70, the holder stopper 75 positioned at the restricting position is moved toward the allowing position to disengage the hooks 753 from the roller frame 70. Thereafter, the roller holder 71 is moved from the non-detachable position toward the detachable position while the user's hand is released from the holder stopper 75. The movement of the roller holder 71 can be performed by the user's hand which has released the holder stopper 75.

During the movement of the roller holder 71 from the non-detachable position to the detachable position, the sloped surfaces 753*c* of the holder stopper 75 contact the right end 723 of the roller holder 71, whereby the roller holder 71 can be smoothly moved to the detachable position without any hooking of the roller holder 71 to the holder stopper 75.

As a result, the operation for moving the holder stopper 75 from the restricting position toward the allowing position and the operation for moving the roller holder 71 from the non-detachable position to the detachable position can be performed with a single hand. That is, the movement of the roller holder 71 in the left-right direction is not hindered despite the fact that the holder stopper 75, which has been moved from the restricting position toward the allowing position, is not held by the user's hand, and thus the roller holder 71 can be moved with a single hand.

Further, the sloped surfaces 753*c* with which the right end 723 of the roller holder 71 is configured to contact are formed in the hooks 753, which are components originally provided in the holder stopper 75. Hence, there is no need to provide the sloped surfaces 753*c* independently of the hooks 753. This configuration can restrain the holder stopper 75 from having a complicated shape.

Further, since the rib 751*a* of the holder stopper 75 is positioned at the left end portion of the holder stopper 75, which is the end portion of the holder stopper 75 closer to the roller holder 71, a direction in which the user hooks the user's finger to the rib 751*a* of the holder stopper 75 during the detachment of the roller holder 71 from the roller frame 70 can be made parallel to the moving direction the roller holder 71, i.e., to the left-right direction. Hence, the operation for moving the holder stopper 75 from the restricting position to the allowing position and the operation for moving the roller holder 71 from the non-detachable position toward the detachable position can be smoothly performed.

Further, in the sheet feeding device 7, the angle θ between the holder stopper 75 positioned at the allowing position and the upper surface of the bottom wall 703, which is a horizontal plane, is an acute angle. With this arrangement, in a case where the user's hand is released from the holder stopper 75 that has been moved to the allowing position, the holder stopper 75 is moved back toward the restricting position by its own weight. Thus, the amount by which the holder stopper 75 protrudes relative to the roller frame 70 can be reduced, thereby restraining an interference between the roller frame 70 and other components, such as the drawer 59 which is attachable to and detachable from the main housing 2 through the front opening 2A.

Further, in the sheet feeding device 7, the engagement protrusions 753*b* of the hooks 753 are brought into contact with the corresponding stepped portions 708 of the roller frame 70 from above during the movement of the holder stopper 75 from the allowing position toward the restricting position in order to restrict the holder stopper 75 from moving to the restricting position due to its own weight. The holder stopper 75 whose movement by its own weight is restricted by the hooks 753 is positioned at the intermediate position, which is a position between the restricting position and the allowing position.

Since the holder stopper 75 is positioned at the intermediate position between the restricting position and the allowing position even when the user's hand is released from the holder stopper 75 after the holder stopper 75 has been moved to the allowing position, the roller holder 71 can be moved from the non-detachable position to the detachable position with a single hand while the roller holder 71 is in contact with the sloped surfaces 753*c* of the holder stopper 75.

Modifications

While the invention has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the invention, and not limiting the invention. Various changes may be made without departing from the spirit and scope of the disclosure. Therefore, the disclosure is intended to embrace all known or later developed alternatives, modifications, variations, improvements, and/or substantial equivalents. Some specific examples of potential alternatives, modifications, or variations in the described invention are provided below.

Figure 14:
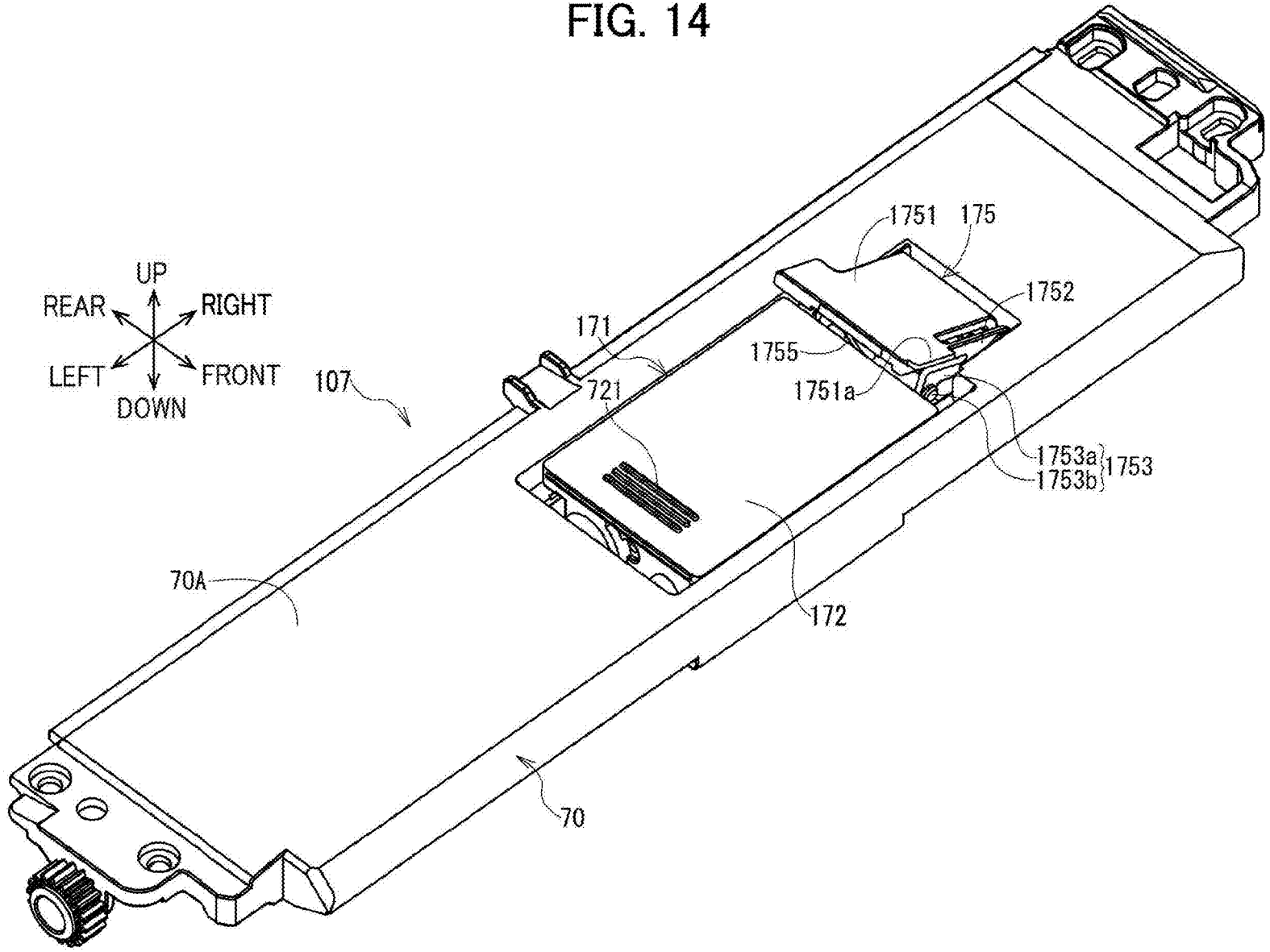
FIG. 14 is a perspective view illustrating the roller frame, a roller holder, and a holder stopper.
Figure 15:
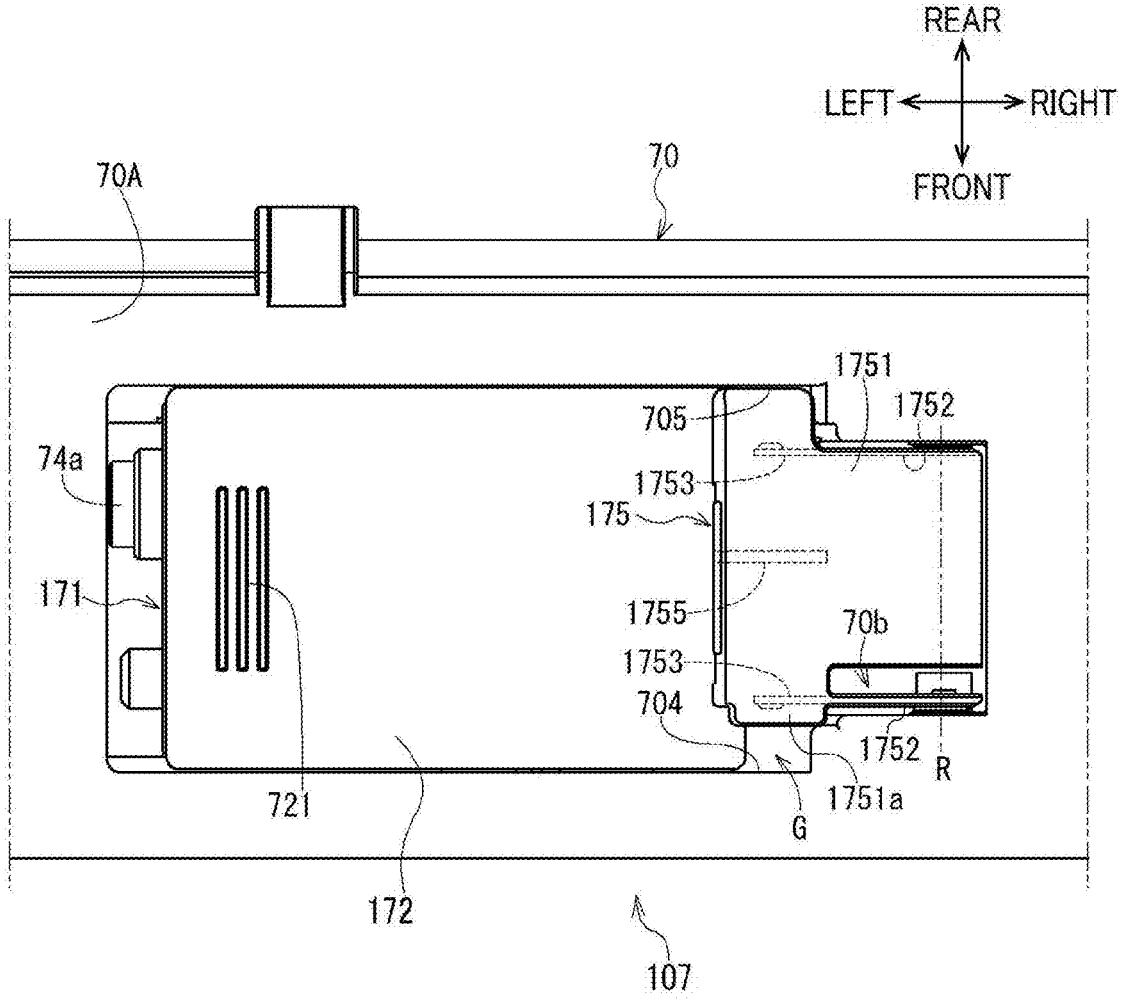
FIG. 15 is a partial plan view illustrating the roller frame, the roller holder, and the holder stopper.
Figure 16:
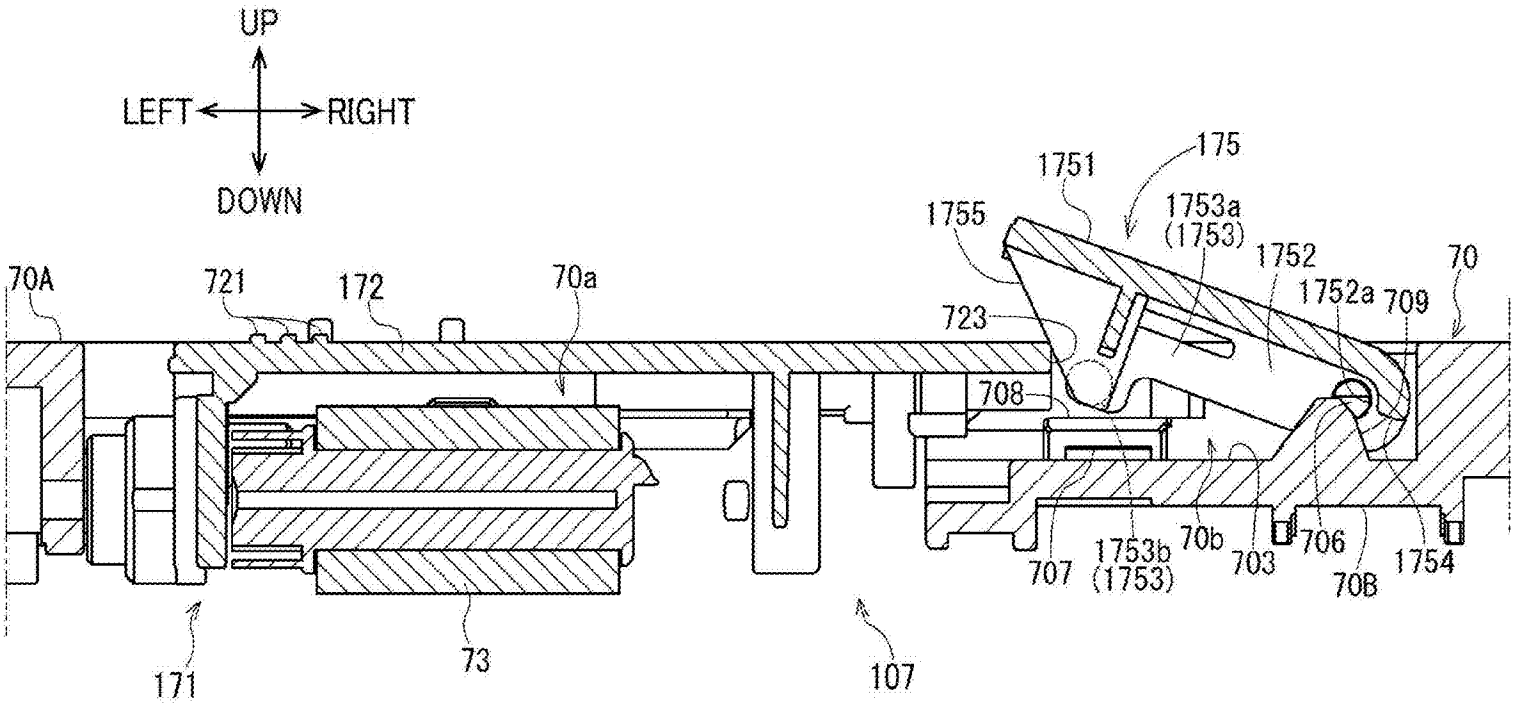
FIG. 16 is a front cross-sectional view illustrating the roller frame, the roller holder, and the holder stopper.

FIGS. 14 through 16 illustrate a sheet feeding device 107 according to a modification of the embodiment. The sheet feeding device 107 includes a holder stopper 175, and a roller holder 171. The holder stopper 175 includes a rib 1751*a*, and has a sloped surface 1755. In the holder stopper 175, the positions of the rib 1751*a* and the sloped surface 1755 are different from the positions of the rib 751*a* and the sloped surfaces 753*c* of the holder stopper 75 in the embodiment. The remaining structure of the holder stopper 175 is the same as that of the holder stopper 75. The roller holder 171 includes a roller cover 172. The roller cover 172 does not have a recess 722, contrary to the roller cover 72 in the embodiment.

The holder stopper 175 is supported by the support groove 70*b* of the roller frame 70. The holder stopper 175 is pivotally movable about the pivot axis R. The holder stopper 175 is movable between the restricting position and the allowing position by pivotally moving about the pivot axis R. The holder stopper 175 is juxtaposed with the roller holder 171 in the left-right direction, which is the moving direction of the roller holder 171, in a state where the holder stopper 175 is at the restricting position and the roller holder 171 is at the non-detachable position.

The holder stopper 175 includes an upper plate 1751, a pair of side plates 1752 (a front side plate 1752 and a rear side plate 1752), and a pair of hooks 1753 (a front hook 1753 and a rear hook 1753), and has a restriction surface 1754. The upper plate 1751 is a flat plate-like member. The rib 1751*a* protrudes from the upper plate 1751 in a direction orthogonal to the moving direction of the holder stopper 175 between the restricting position and the allowing position about the pivot axis R. Specifically, the rib 1751*a* protrudes frontward from a front end of a left end portion of the upper plate 1751.

A gap G (see FIG. 15) is formed between the rib 1751*a* of the holder stopper 175 and the front wall 704 defining the support groove 70*b* of the roller frame 70. The user's finger can be easily hooked to the rib 1751*a* by inserting the finger in the gap G.

The holder stopper 175 can be easily moved between the restricting position and the allowing position by hooking the finger to the rib 1751*a* and moving the holder stopper 175.

The front and rear side plates 1752 protrude downward from a front end and a rear end of the upper plate 1751, respectively. Each of the front and rear side plates 1752 is formed with a support hole 1752*a* penetrating the corresponding side plate 1752 in the front-rear direction. The supporting protrusion 706 of the front wall 704 is inserted through the support hole 1752*a* of the front side plate 1752, and the supporting protrusion 706 of the rear wall 705 is inserted through the support hole 1752*a* of the rear side plate 1752. Insertion of the supporting protrusions 706 through the corresponding support holes 1752*a* enables the holder stopper 175 to be supported by the support groove 70*b* so as to be pivotally movable about the pivot axis R.

Each of the front and rear hooks 1753 includes an elastic piece 1753*a* extending leftward from the corresponding side plate 1752, and an engagement protrusion 1753*b* protruding in the front-rear direction from the left end portion of the corresponding elastic piece 1753*a*. Specifically, the engagement protrusion 1753*b* of the front hook 1753 protrudes frontward from the elastic piece 1753*a* of the front hook 1753, and the engagement protrusion 1753*b* of the rear hook 1753 protrudes rearward from the elastic piece 1753*a* of the rear hook 1753.

The engagement protrusions 1753*b* of the hooks 1753 are configured to be engaged with the corresponding engagement grooves 707 in the roller frame 70. Specifically, the engagement protrusion 1753*b* of the front hook 1753 is configured to be engaged with the engagement groove 707 in the front wall 704 of the roller frame 70, and the engagement protrusion 1753*b* of the rear hook 1753 is configured to be engaged with the engagement groove 707 in the rear wall 705 of the roller frame 70. The holder stopper 175 is fixed to be maintained at the restricting position relative to the roller frame 70 due to the engagement between the hooks 1753 and the roller frame 70.

The engagement protrusions 1753*b* of the hooks 1753 are configured to abut on the corresponding stepped portions 708 of the support groove 70*b* of the roller frame 70 from above. The holder stopper 175 is at the intermediate position between the restricting position and the allowing position in a state where the engagement protrusions 1753*b* are in contact with the corresponding stepped portions 708.

The restriction surface 1754 is brought into contact with the restricting piece 709 of the roller frame 70 when the holder stopper 175 has been moved to the allowing position. The restriction surface 1754 is formed at a right end portion of the upper plate 1751 of the holder stopper 175. The restriction surface 1754 contacts the restricting piece 709 in a state where the holder stopper 175 is at the allowing position in order to restrict the holder stopper 175 from moving from the allowing position in a direction away from the restricting position.

The sloped surface 1755 protrudes downward from a center portion (see FIG. 15) in the front-rear direction of the upper plate 1751. The sloped surface 1755 is inclined relative to the left-right direction, which is the moving direction of the roller holder 171, both in a state where the holder stopper 175 is at the restricting position and in a state where the holder stopper 175 is at the intermediate position. The sloped surface 1755 is inclined diagonally upward as extending leftward.

The sloped surface 1755 is positioned between the front hook 1753 and the rear hook 1753 in the front-rear direction. That is, the sloped surface 1755 is provided at a portion of the holder stopper 175 other than the front and rear hooks 1753.

The sloped surface 1755 is configured to contact the roller holder 171 which is positioned between the non-detachable position and the detachable position in a state where the holder stopper 75 is at the intermediate position, for example. Specifically, the sloped surface 1755 is configured to contact the right end 723 of the roller holder 171, which is the downstream end of the roller cover 172 in the direction from the non-detachable position to the detachable position (i.e., the specific direction).

In the holder stopper 175 according to this modification, the rib 1751*a* is positioned at the front end of the upper plate 1751, and the sloped surface 1755 is formed at a portion of the holder stopper 175 other than the front and rear hooks 1753. Because the sloped surface 1755 and the front and rear hooks 1753 are at positions different from each other, an enhanced degree of freedom in the arrangement of the sloped surface 1755 in the holder stopper 175 can be attained.

What is claimed is:

1. A sheet feeding device comprising:

a frame;

a feeding roller rotatable about an axis extending in an axial direction, the feeding roller being configured to feed a sheet;

a holder holding the feeding roller, the holder being attachable to the frame, the holder attached to the frame being movable in the axial direction relative to the frame between:

a non-detachable position in which the holder is non-detachable from the frame; and a detachable position in which the holder is detachable from the frame; and a stopper movable between:

a restricting position in which the stopper restricts the holder from moving in a specific direction, the specific direction being a direction from the non-detachable position toward the detachable position; and an allowing position in which the stopper allows the holder to move in the specific direction, wherein the stopper has a sloped surface sloped relative to the axial direction so as to extend downward toward a downstream side in the specific direction, the sloped surface being configured to contact a portion of the holder on the downstream side in the specific direction, wherein the stopper comprises:

a hook configured to be engaged with the frame to maintain the stopper at the restricting position relative to the frame, and wherein the hook has the sloped surface.

2. The sheet feeding device according to claim 1, wherein the stopper comprises:

a rib protruding in a direction orthogonal to a moving direction in which the stopper is movable, the rib being usable by a user to move the stopper in the moving direction.

3. The sheet feeding device according to claim 2, wherein the holder comprises:

a cover holding the feeding roller, the cover having a recess, the recess being juxtaposed with the rib in the axial direction in a state where the holder is at the non-detachable position and the stopper is at the restricting position.

4. The sheet feeding device according to claim 3, wherein the stopper is juxtaposed with the holder in the axial direction in the state where the holder is at the non-detachable position and the stopper is at the restricting position, wherein the stopper has one end portion and an other end portion in the axial direction, the one end portion of the stopper being positioned closer to the holder in the axial direction than the other end portion of the stopper is to the holder, wherein the holder has one end portion and an other end portion in the axial direction, the other end portion of the holder being positioned closer to the stopper in the axial direction than the one end portion of the holder is to the stopper, wherein the rib is provided at the one end portion of the stopper, and wherein the recess is provided at the other end portion of the holder.

5. The sheet feeding device according to claim 1, wherein the stopper is pivotally movable between the restricting position and the allowing position about a pivot axis extending in a direction orthogonal to the axial direction, and wherein an angle between the stopper positioned at the allowing position and a horizontal plane is an acute angle.

6. The sheet feeding device according to claim 1, wherein the frame comprises:

a restricting piece configured to contact the stopper positioned at the allowing position to restrict the stopper from moving from the allowing position in a direction away from the restricting position.

7. The sheet feeding device according to claim 1, wherein the stopper is configured to, when moving between the allowing position and the restricting position, pass through an intermediate position between the allowing position and the restricting position, and wherein, when the stopper has moved to the intermediate position from the allowing position, the hook contacts the frame to restrict the stopper from moving toward the restricting position due to its own weight.

8. A sheet feeding device comprising:

a frame;

a feeding roller rotatable about an axis extending in an axial direction, the feeding roller being configured to feed a sheet;

a holder holding the feeding roller, the holder being attachable to the frame, the holder attached to the frame being movable in the axial direction relative to the frame between:

a non-detachable position in which the holder is non-detachable from the frame; and a detachable position in which the holder is detachable from the frame; and a stopper movable between:

a restricting position in which the stopper restricts the holder from moving in a specific direction, the specific direction being a direction from the non-detachable position toward the detachable position; and an allowing position in which the stopper allows the holder to move in the specific direction, wherein the stopper has a sloped surface sloped relative to the axial direction so as to extend downward toward a downstream side in the specific direction, the sloped surface being configured to contact a portion of the holder on the downstream side in the specific direction, wherein the stopper comprises:

a rib protruding in a direction orthogonal to a moving direction in which the stopper is movable, the rib being usable by a user to move the stopper in the moving direction, wherein the holder comprises:

a cover holding the feeding roller, the cover having a recess, the recess being juxtaposed with the rib in the axial direction in a state where the holder is at the non-detachable position and the stopper is at the restricting position, wherein the cover further has an upper surface, and wherein in a state where the stopper is at the restricting position, the recess is recessed downward from the upper surface of the cover.

9. The sheet feeding device according to claim 8, wherein the stopper comprises:

a hook configured to be engaged with the frame to maintain the stopper at the restricting position relative to the frame, and wherein the hook has the sloped surface.

10. The sheet feeding device according to claim 8, wherein the stopper is juxtaposed with the holder in the axial direction in the state where the holder is at the non-detachable position and the stopper is at the restricting position, wherein the stopper has one end portion and an other end portion in the axial direction, the one end portion of the stopper being positioned closer to the holder in the axial direction than the other end portion of the stopper is to the holder, wherein the holder has one end portion and an other end portion in the axial direction, the other end portion of the holder being positioned closer to the stopper in the axial direction than the one end portion of the holder is to the stopper, wherein the rib is provided at the one end portion of the stopper, and wherein the recess is provided at the other end portion of the holder.

11. The sheet feeding device according to claim 8, wherein the stopper is pivotally movable between the restricting position and the allowing position about a pivot axis extending in a direction orthogonal to the axial direction, and wherein an angle between the stopper positioned at the allowing position and a horizontal plane is an acute angle.

12. The sheet feeding device according to claim 8, wherein the frame comprises:

a restricting piece configured to contact the stopper positioned at the allowing position to restrict the stopper from moving from the allowing position in a direction away from the restricting position.

13. The sheet feeding device according to claim 9, wherein the stopper is configured to, when moving between the allowing position and the restricting position, pass through an intermediate position between the allowing position and the restricting position, and wherein, when the stopper has moved to the intermediate position from the allowing position, the hook contacts the frame to restrict the stopper from moving toward the restricting position due to its own weight.

14. A sheet feeding device comprising:

a frame;

a feeding roller rotatable about an axis extending in an axial direction, the feeding roller being configured to feed a sheet;

a holder holding the feeding roller, the holder being attachable to the frame, the holder attached to the frame being movable in the axial direction relative to the frame between:

a non-detachable position in which the holder is non-detachable from the frame; and a detachable position in which the holder is detachable from the frame; and a stopper pivotally movable about a pivot axis extending in a direction orthogonal to the axial direction between:

a restricting position in which the stopper restricts the holder from moving in a specific direction, the specific direction being a direction from the non-detachable position toward the detachable position; and an allowing position in which the stopper allows the holder to move in the specific direction, wherein the stopper has a sloped surface sloped relative to the axial direction so as to extend downward toward a downstream side in the specific direction, the sloped surface being configured to contact a portion of the holder on the downstream side in the specific direction, and wherein the frame comprises:

a restricting piece positioned further downward relative to the pivot axis of the stopper, the restricting piece being configured to contact the stopper positioned at the allowing position to restrict the stopper from moving from the allowing position in a direction away from the restricting position.

15. The sheet feeding device according to claim 14, wherein the stopper comprises:

a rib juxtaposed with the holder in the axial direction in a state where the holder is at the non-detachable position and the stopper is at the restricting position, the rib protruding in a direction orthogonal to a moving direction in which the stopper is movable, the rib being usable by a user to move the stopper in the moving direction; and a hook configured to be engaged with the frame to maintain the stopper at the restricting position relative to the frame, wherein the rib is provided at an end portion of the stopper in a direction orthogonal to the axial direction, and wherein the sloped surface is provided at a portion of the stopper other than the hook.

16. The sheet feeding device according to claim 14, wherein the stopper comprises:

a rib protruding in a direction orthogonal to a moving direction in which the stopper is movable, the rib being usable by a user to move the stopper in the moving direction.

17. The sheet feeding device according to claim 16, wherein the holder comprises:

a cover holding the feeding roller, the cover having a recess, the recess being juxtaposed with the rib in the axial direction in a state where the holder is at the non-detachable position and the stopper is at the restricting position.

18. The sheet feeding device according to claim 17, wherein the stopper is juxtaposed with the holder in the axial direction in the state where the holder is at the non-detachable position and the stopper is at the restricting position, wherein the stopper has one end portion and an other end portion in the axial direction, the one end portion of the stopper being positioned closer to the holder in the axial direction than the other end portion of the stopper is to the holder, wherein the holder has one end portion and an other end portion in the axial direction, the other end portion of the holder being positioned closer to the stopper in the axial direction than the one end portion of the holder is to the stopper, wherein the rib is provided at the one end portion of the stopper, and wherein the recess is provided at the other end portion of the holder.

19. The sheet feeding device according to claim 14, wherein an angle between the stopper positioned at the allowing position and a horizontal plane is an acute angle.

* * * * *